US006753894B2

(12) United States Patent
Yoshida

(10) Patent No.: US 6,753,894 B2
(45) Date of Patent: Jun. 22, 2004

(54) IMAGE RECORDING APPARATUS, THERMAL TRANSFER INK RIBBON AND THERMAL TRANSFER INK RIBBON CASSETTE USED IN THIS IMAGE RECORDING APPARATUS

(75) Inventor: Naoki Yoshida, Tokyo (JP)

(73) Assignees: Wedg Co., Ltd., Tokyo (JP); Altech Co., Ltd., Tokyo (JP)

( * ) Notice: Subject to any disclaimer, the term of this patent is extended or adjusted under 35 U.S.C. 154(b) by 253 days.

(21) Appl. No.: 09/992,202

(22) Filed: Nov. 14, 2001

(65) Prior Publication Data

US 2002/0180859 A1 Dec. 5, 2002

(30) Foreign Application Priority Data

May 30, 2001 (JP) ..... 2001-161614
Jun. 8, 2001 (JP) ..... 2001-173913

(51) Int. Cl.[7] ..... B41J 33/52
(52) U.S. Cl. ..... 347/217; 400/234
(58) Field of Search ..... 400/223, 234, 400/225; 347/197, 217

(56) References Cited

U.S. PATENT DOCUMENTS 5,080,512 A * 1/1992 Schofield et al. ..... 400/225

* cited by examiner

*Primary Examiner*—Huan Tran
(74) *Attorney, Agent, or Firm*—McGlew and Tuttle, P.C.

(57) ABSTRACT

An image recording apparatus for producing a finished sheet of recording medium with an image printed thereon includes an image recorder with a platen drum, a clamper, a movable guide provided in an entrance side around said platen drum and a fixed guide adjacent to said movable guide. A paper feed has a recording medium wound up in a roll state for providing recording medium sheets upon cutting, a paper feed side cutter, paper feed rollers and a paper feed side slide guide. A thermal transfer ink ribbon with heatable coloring materials is heated by a thermal head. A paper discharge has a paper discharge side slide guide with a tip portion for receiving the recording medium and also having a paper discharge side cutter. A paper waste patting bar is rotatably provided between an exit of said paper discharge side slide guide and said paper discharge cutter and a paper discharge roller is provided for discharging the finished recording medium. A single interlocked driving system may be connected to said paper feed side cutter and said paper discharge side cutter to be synchronously operated. A tension switch may be provided for switching tension of the ink ribbon to a larger value or a smaller value provided in the ribbon feed-out side. The ribbon may be provided for use with a wind-up core for winding up said ink ribbon and a feed-out side core. The ribbon may be part of a cassette with a chip which operates when a power is supplied in a non-contact form to a portion of this ribbon cassette and also which incorporates therein a coil and a semiconductor circuit each capable of receiving and transmitting data in a non-contact form.

4 Claims, 19 Drawing Sheets

IMAGE RECORDING APPARATUS, THERMAL TRANSFER INK RIBBON AND THERMAL TRANSFER INK RIBBON CASSETTE USED IN THIS IMAGE RECORDING APPARATUS

FIELD OF THE INVENTION

The present invention relates to a thermal transfer type of image recording apparatus for recording a color image with an image recording means comprising a thermal head and a thermal transfer type of ink ribbon in an image recording medium wound around a platen drum based on image data recorded in an image data recording means or transmitted through a communication means and also relates to a thermal transfer type of ink ribbon and a thermal transfer type of ink ribbon cassette used in this image recording apparatus.

BACKGROUND OF THE INVENTION

A conventional type of image recording apparatus is shown in FIG. 1. The image recording apparatus shown in FIG. 1 comprises a thermal transfer type of ink ribbon 500, an image recording medium 501, a platen drum 502, a thermal head 503, a damper 504, a platen drum driving motor 505, and a recording medium hopper 506. A contact section between the damper 504 and the recording medium 501 is covered with a frictional member 509 such as rubber adhered thereto. In FIG. 1, the thermal head 503, a thermal transfer type of ink ribbon 500, recording medium 501, and platen drum 502 are arranged in this order. The thermal transfer type of ink ribbon 500 is colored with different colors cyclically and a wound around in the feeder core 507 in a rolled form, and is wound up around a winder core 508 in the opposite side. For instance, the three colors of yellow, magenta, and cyan form one group. In some ribbons, black or a transparent overcoat material for coating the surface is added to the three colors described above. The following description of operations assumes a three-color ribbon. At first, a header section of the thermal transfer type of ink ribbon 500 with a given color is positioned at the starting position. Then the recording medium 501 is carried from the recording medium hopper 506 to the damper 504 and is wound around the platen drum 502. Then recording medium 501 carried thereto is held between the platen drum 502 and damper 504 each loading a pressure thereto to hold it. The a rear surface of the damper 504, namely a section contacting the recording medium 501 is made from a frictional member 509 such as rubber, and holds the recording medium 501 by means of the frictional force. When the recording medium 501 is firmly held, the thermal head 503 is moved to the platen drum 502 and a pressure is loaded to the thermal head 503 so that the thermal transfer type of ink ribbon 500 and recording medium 501 are closely adhered to each other. Then the platen drum driving motor 505 rotates with the thermal head 503 energized and heated in synchronism to start of rotation thereof according to an arbitrary dot so that the heated color material is transferred from the thermal transfer type of ink ribbon 500 onto the recording medium 501 and an image is formed thereon. After processing with the first color is finished, the thermal head 503 releases the pressure, moves away from the platen drum 502, and feeds the thermal transfer type of ink ribbon 500 to position a section with the next color at its starting position with the platen drum 502 rotating in the image-forming direction to position the recording medium 501 at its starting position. Further, the same operations as those described above are repeated to form a image for a next color, and thus the operation sequence is repeated required times to form a color image.

The most important requirement in this operation sequence is that positioning of the recording medium 501 at its starting position is performed by controlling a position of the platen drum 502. Therefore, to prevent change in a positional relation between the platen drum 502 and the recording medium 501 to be wounded therearound for each color, the platen drum 502 and the recording medium 501 are held by such a tool as the damper 504 with the frictional member 509 such as rubber adhered thereto.

In the conventional type of image recording apparatus as described above, recording medium 501 are fed one by one from the recording medium hopper 506 to the platen drum 502, and a header section of this recording medium 501 is clamped by the damper 504 to the platen drum 502 with a rear edge section of the recording medium 501 held by a pinch roller between the pinch roller and the platen drum 502. Because of this configuration, a load by the pinch roller gives effects over the platen drum 502 so that a driving load for the platen drum 502 disadvantageously increases.

In some of the image recording apparatuses based on the conventional technology, the recording medium 501 are not fed one by one, and the recording medium wound up into a roll form is cut into sheets, which are fed one by one. In this roll system, the recording medium 501 fed out from a roll is cut into a sheet of recording medium 501, which is wound around the platen drum 502, and then an image is recorded on this recording medium 501 with the thermal head 503 and thermal transfer type of ink ribbon 500, and when the recording medium 501 with the image recorded thereon is to be discharged, the platen drum 502 is rotated in the reverse direction to liberate the recording medium 501 with the image printed thereon from the platen drum 502, and a blank section having been held by the dampers 504 is cut off with a discharge cutter to form a sheet of recording medium 501 with the image having been recorded therein, but in this system, the paper feed means, recording means, paper discharge means and drive means are independently provided respectively, and operations of each means are controlled by a control circuit.

Because of this configuration, the size of the apparatus as a whole becomes larger, and two or more driving motors and two or more driving mechanisms including those for a paper feed cutter and a paper discharge cutter are required, which in turn makes the cost higher and also makes the size larger. In addition, although a time required for recording can be reduced by performing paper feed and paper discharge at the same time, a complicated control mechanism is required to control the two or more motors and the driving mechanisms synchronously, and a synchronism error easily occurs, and therefore it is necessary to make to some extent lower an operating speed in the operation sequence, and at present it takes about 30 seconds to finish a sheet of recording medium with an image recording apparatus using a normal type of thermal head and ink ribbon.

Further paper waste generated in cutting operations by the paper discharge cutter may sometimes be taken together with the recording medium in the paper discharge side, which may in turn cause the so-called paper jamming.

In the conventional type of image recording apparatus shown in FIG. 1, a two-roll type of ink ribbon having the ribbon cores 507 and 508 both in the feed-out side and in the wind-up side or a ribbon cassette with the two-roll type of ink ribbon incorporated therein is used for the thermal transfer type of ink ribbon 500. When a ribbon core of this ribbon cassette is set in the image recording apparatus, the core 508 in the wind-up side is engaged with a core boss in the wind-up side driven directly or via a clutch mechanism by a motor, while the core 507 in the feed-out side is engaged with a core boss in the feed-out side loading a prespecified torque via a frictional clutch or the like to the core 507 in the feed-out side to give tension to the ribbon.

As clearly shown by the configuration, a torque loaded by the frictional clutch or the like to the conventional type of core 507 in the feed-out side is always kept at a constant level, so that the problems as described below occur.

1. When positioning a recording medium at its starting position, a torque loaded to the core 508 in the wind-up side is required to be larger than that loaded to the core 507 in the feed-out side. Therefore, when a ribbon wound into a roll with many turns is used, a difference between diameters of turns is in inverse proportion to the ribbon tension, so that a adjustment width in setting torques in the wind-up side and feed-out side is very narrow. As a result, sometimes the ribbon gets wrinkled due to shortage of tension to cause mismatching between images with different colors respectively, and further such troubles such as break of the ribbon often occur due to the excessive tension, so that a ribbon with the narrow adjustment width can not be used.
2. When a torque in the feed-out side is set smaller, the problem (1) is solved, but positioning of a recording medium at its starting position can not be performed correctly because of shortage of the tension, or mismatching between images with different colors often occur due to the insufficient tension during printing an image, which makes it impossible to obtain a high quality image.
3. The ribbon tension is adjusted for printing an image, so that the tension is generally excessive for positioning of a recording medium at its starting position, and therefore sometimes the speed for positioning of a recording medium at its starting position may become lower, and the electric energy consumed by a motor for positioning of a recording medium at its starting position may become larger.

As described above, in the conventional type of image recording apparatus based on the conventional technology, as a torque is loaded to the core in the feed-out side with a single frictional clutch by referring to the ribbon tension set for printing an image as a reference, the ribbon tension in operations for positioning at its starting position is generally excessive, so that the excessive tension must be released for positioning the ink ribbon at its starting position. On the other hand, a sufficient tension is required to be loaded to the ribbon for recording a high quality image in printing an image.

In a case of the conventional type of ribbon cassette, ribbon cores are provided also in both the ribbon wind-up side and ribbon feed-out side, and when the ribbon is used to its end, generally the ribbon cassette is disposed as waste together with the used ink ribbon film. A ribbon core generally uses components made from plastics such as vinyl chloride or a paper tube, but when such recent requirements as environmental contamination by industrial and municipal wastes and product cost reduction are taken into considerations, a structure based on the considerations to simplification and the possibility of recycled use is desired. Even when the costs for transporting and packaging the ink ribbon are taken into considerations, it is desirable to abolish a ribbon core in the wind-up side and also to minimize a package of ink ribbon. In addition, when the needs for home use and convenience for general users are taken into considerations, the attachment method should preferably be as simple as possible.

Next, in the conventional type of image recording apparatus, a thermal transfer type of ink ribbon is accommodated in a ribbon cassette, and this ribbon cassette has a protrusion such as a pin or a notch provided to indicates a type of the ribbon, and data concerning the ribbon such as a physical type of the ribbon is read with a detection switch, and in other cases a bar code seal is provided to indicates the ribbon type and the bar code seal is read with a bar code sensor or other appropriate means. When a physical means such as a pin is used to indicate a type of ribbon, the data is limited to a bit number of pins or the like, and a number of sensors are required. For instance, when 256-bit data is to be expressed, at least eight pins and sensors are required. Further, although bar code is used in some cases, a quantity of data expressed by the bar code is limited to at most 1 Kb, and the quantity of data is too small to use the bar code for transmitting information on color materials used in the thermal transfer type of image recording apparatus generally requiring at least 2 Kb for one color. Further, when an expression method based on the conventional technology is employed, the data can not be updated, and a number of remaining ribbon sheets changing from time to time can not be recorded at all. It was also tried to use an IC based on the contact system, but in this case an electrical contact is required, and the reliability is low because of deposition of dust, oil, and other foreign materials on the contact point, so that it has not been used in the thermal transfer type of ribbon cassette.

As described above, there have been several problems in the image recording apparatus based on the conventional technology. One of the problems is that non-uniformity in production of ribbons or a difference in the coloring characteristics due to change of a coloring material is not reflected as data to a ribbon cassette, and in some cases when a ribbon cassette is exchanged with another one, an image with different color tone may be produced with the other image recording apparatus even for the same image data.

The second problem is that, although a residual quantity of a ribbon in a ribbon cassette decreases as production of images goes on, it becomes impossible to detect the residual quantity at a certain point of times. In the conventional technology, detection of the residual quantity of a ribbon is performed by measuring an external form of the ribbon with a sensor or by putting an end marker on a ribbon and detecting the end marker. In this case, for instance, when detection is performed by measuring an external form of a ribbon, it is difficult to accurately check a residual quantity of ribbon having the thickness of only several microns, and an error of around 20% always occurs. When the detection is performed by checking the end marker, it is possible only to check whether the current sheet is a final one or not, and it is at present impossible to print how many sheets of images can be printed. Further, when only the physical detection is performed in the state where a ribbon has been set, if the ribbon has partially been used, a count on a number of sheets of images already print shown by the apparatus is completely different from the actual result. As described above, with the conventional system, how many sheets of images can be printed can not accurately been detected at all.

SUMMARY OF THE INVENTION

The present invention provides a thermal transfer type of image recording apparatus in which an image recording medium having been wound up into a roll is cut into a sheet of recording medium; the recording medium cut as described above is wound around a platen drum; coloring matters on the thermal transfer type of ink ribbon are heated by a thermal head and transcribed onto the recording medium; the recording medium with an image already printed thereon is released from the platen drum; and a blank space for being held by the damper on the released recording medium with an image already printed thereon is cut off to provide a finally finished recording medium with an image already printed thereon. A paper feed means in this apparatus feeds out a recording medium would up into a roll state holding it between paper feed rollers, passes the recording medium between a rotary blade and a fixed blade of the paper feed cutter, feeds out the recording medium by a prespecified quantity holding the recording paper with paper feed rollers in the paper feed side onto a slide guide in the paper feed side, fixes a tip of the recording medium with a damper on to the platen drum, and cuts the recording medium with the cutter in the paper feed side into a sheet of recording medium. The image recording means of the image recording apparatus has the configuration in which a platen drum with a damper is positioned in front of the slide guide in the paper feed side of the paper feed means; a movable guide positioned in the entrance side opposite to an exit for the slide guide in the paper feed side and a guide device constituting a fixed guide are provided around this platen drum. The paper discharge means of the image recording apparatus has the configuration in which a paper discharge side slide guide with a paper discharge side roller with an inlet port for receiving a recording medium with an image already printed thereon released from the platen drum when the platen drum is rotated in the reverse direction from its rear side is provided in front of an entrance for the movable guide of the image recording means; a paper discharge side cutter comprising a rotary blade and a fixed cutter is provided at an exit of the slide guide in the paper discharge side; a paper waste patting bar is rotatably provided between the exit of the slide guide in the paper discharge side and the cutter in the paper discharge side; and further a paper discharge roller for discharging the recording medium with an image already printed thereon from inside of the apparatus is provided in the discharge side of the paper discharge side cutter.

With the configuration as described above, size reduction of an image recording apparatus is possible. Further in the image recording apparatus described above, the configuration is allowable in which drive systems for a cutter mechanism, a platen drum, a thermal transfer mechanism, and a paper discharge mechanism are provided in a series and all of the drive systems can be driven by one drive motor.

The image recording apparatus according to the present invention is an image recording apparatus based on a thermal sublimation system in which an ink ribbon in a thermal transfer type of ink ribbon cassette is heated and an image is recorded by transferring the heated color materials onto a recording medium, and this image recording apparatus according to the present invention is characterized in that a tension switch means for setting a tension of the ink ribbon to either a large value or a small value is provided in the ribbon feed-out side and the tension switch means is switched to the large value side when recording an image and to the small value side when the ribbon is positioned to its starting position.

Further the image recording apparatus according to the present invention has also the configuration in which a tension cam switch is attached to a thermal head up/down camshaft for driving the thermal head up and down so that the tension switch means can be switched in synchronism to up/down movement of the thermal head.

The tension switch means comprises a main frictional clutch for setting the tension to the larger side in synchronism to up/down movement of the thermal head and a sub frictional clutch for setting the tension to the smaller side.

The image recording apparatus according to the present invention is characterized in that a ribbon wind-up core is provided in the image recording apparatus side and therefore an ink ribbon based on a simple structure not having a ribbon core in the wind-up side is used. This ink ribbon can easily be loaded on and off.

The image recording apparatus according to the present invention incorporates, in a portion of the ribbon cassette, an IC chip in which a coil and a semiconductor integrated circuit each capable of operating, receiving and transmitting data in a non-contact form when a power is supplied are integrated with each other, so that the image recording apparatus can read, record and rewrite data concerning the ribbon. Because of this feature, a quantity of data, which is not achievable with such methods as bar code, can be read, recorded, and rewritten without causing the problems such as a contact fault which may occur when a contact type of IC chip is used.

When data concerning characteristics of coloring materials applied on a ribbon accommodated in a ribbon cassette is recorded, it becomes possible to correct a difference in the coloring characteristics due to non-uniformity of ribbons generated during production thereof or change of the coloring materials by making use of the availability of a large quantity of data for the image recording apparatus to read the data for providing optimal control.

Further, a residual quantity of a ribbon set in a ribbon cassette becomes smaller as a number of printed images increases, and the residual quantity of a ribbon in a ribbon cassette based on the conventional technology is detected by measuring an external form of the ribbon with a sensor or by previously putting a marker indicating a header or an end of the ribbon and checking the marker, but an accurate residual quantity of ribbon at a given point of time can not be detected at all. With the present invention, however, a number of used ribbon sheets may be written in an IC chip inside the ribbon cassette each time the ribbon is used, so that an accurate residual quantity of ribbon can be detected. Therefore, such a case as that where a ribbon comes to its end and printing is disabled during a printing operation never occurs, and even if a ribbon cassette is exchanged with a new one during a printing operation, the ribbon can be used up to the final one sheet without fail.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
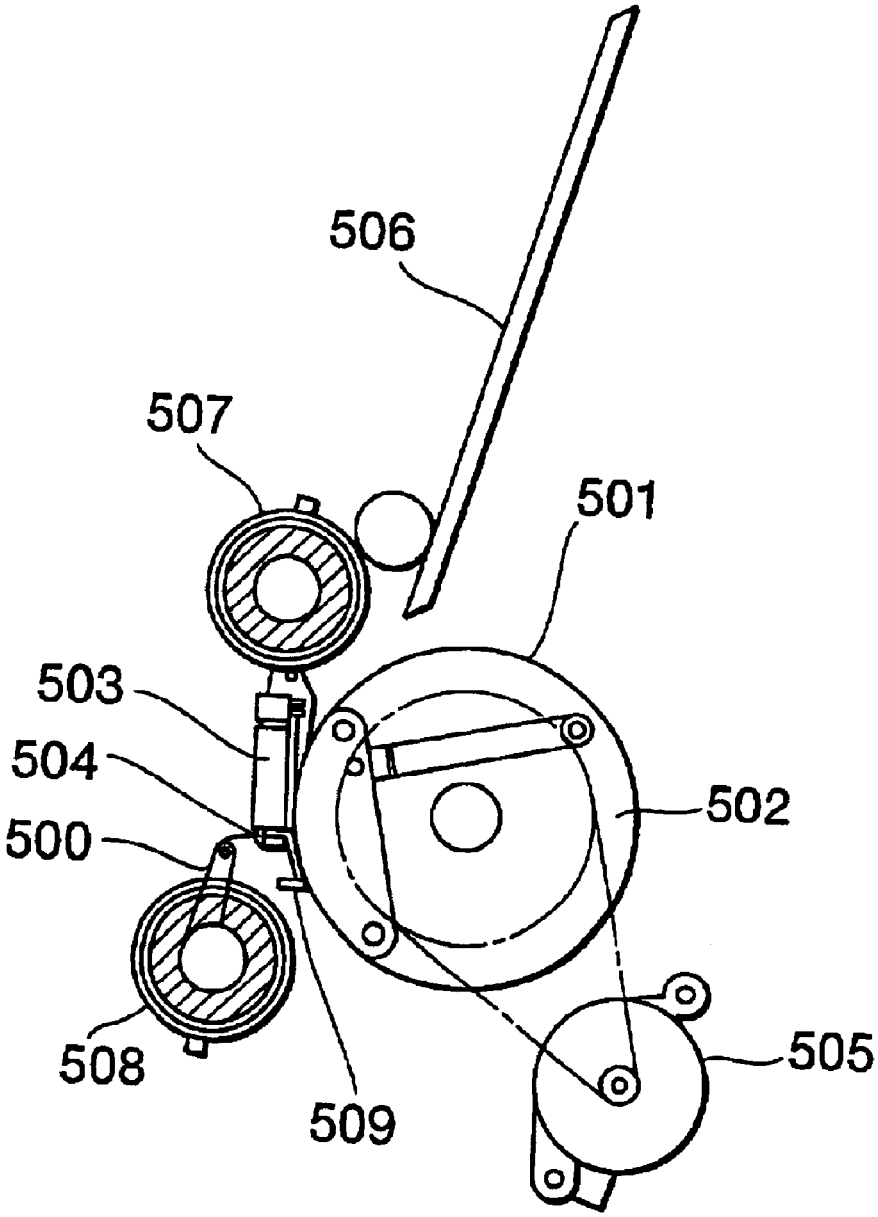
FIG.1 PRIOR ART
FIG. 1 is an explanatory view showing a thermal sublimation type of image recording apparatus based on the conventional technology.
Figure 2:
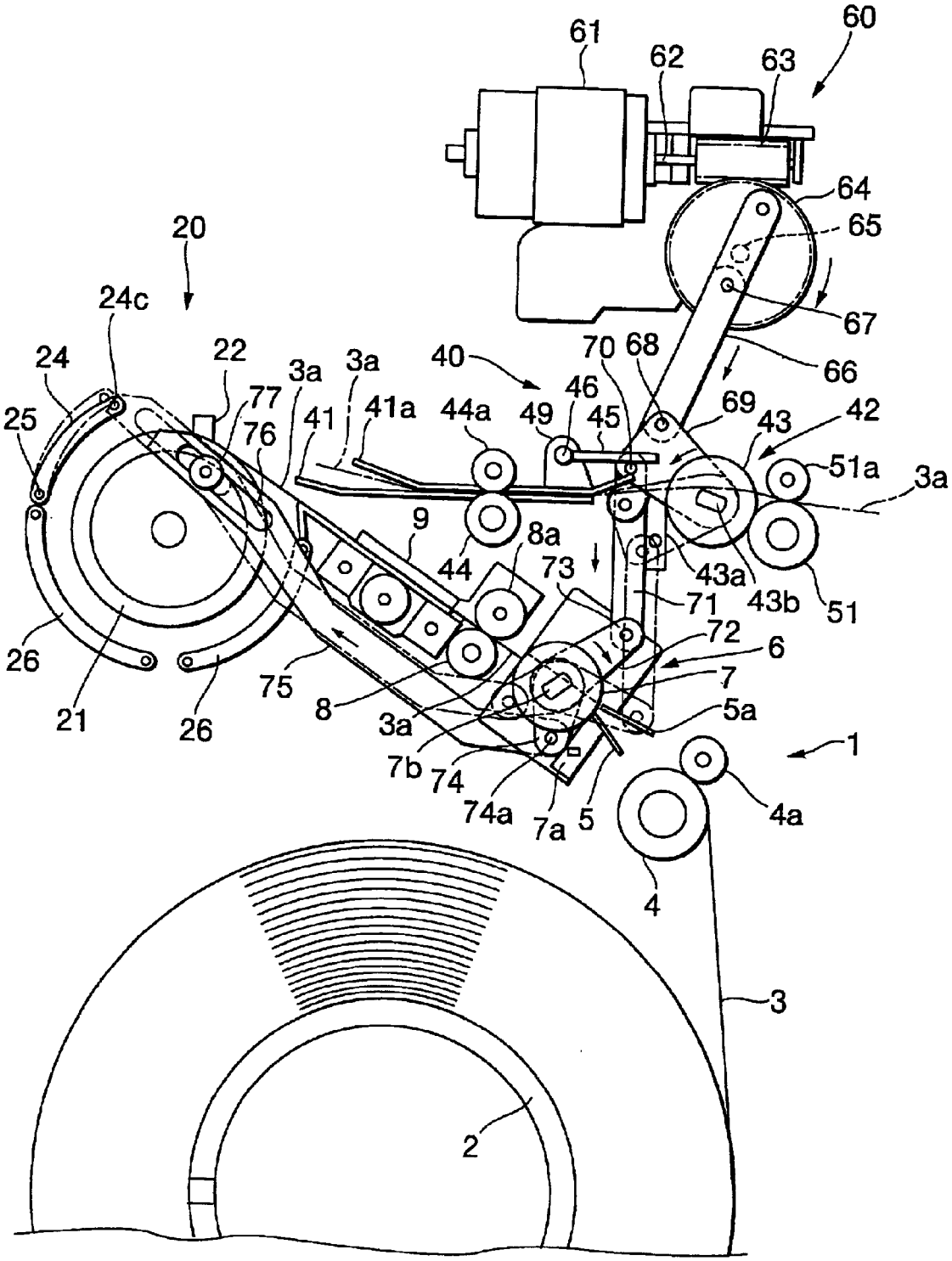
FIG. 2 is an explanatory view showing a side view of an image recording apparatus according to an embodiment of the present invention in which a recording medium is fed out from a roll and the recording medium with an image already printed thereon is sent from its rear edge side to the paper discharge side and only one drive motor is used therein.
Figure 3:
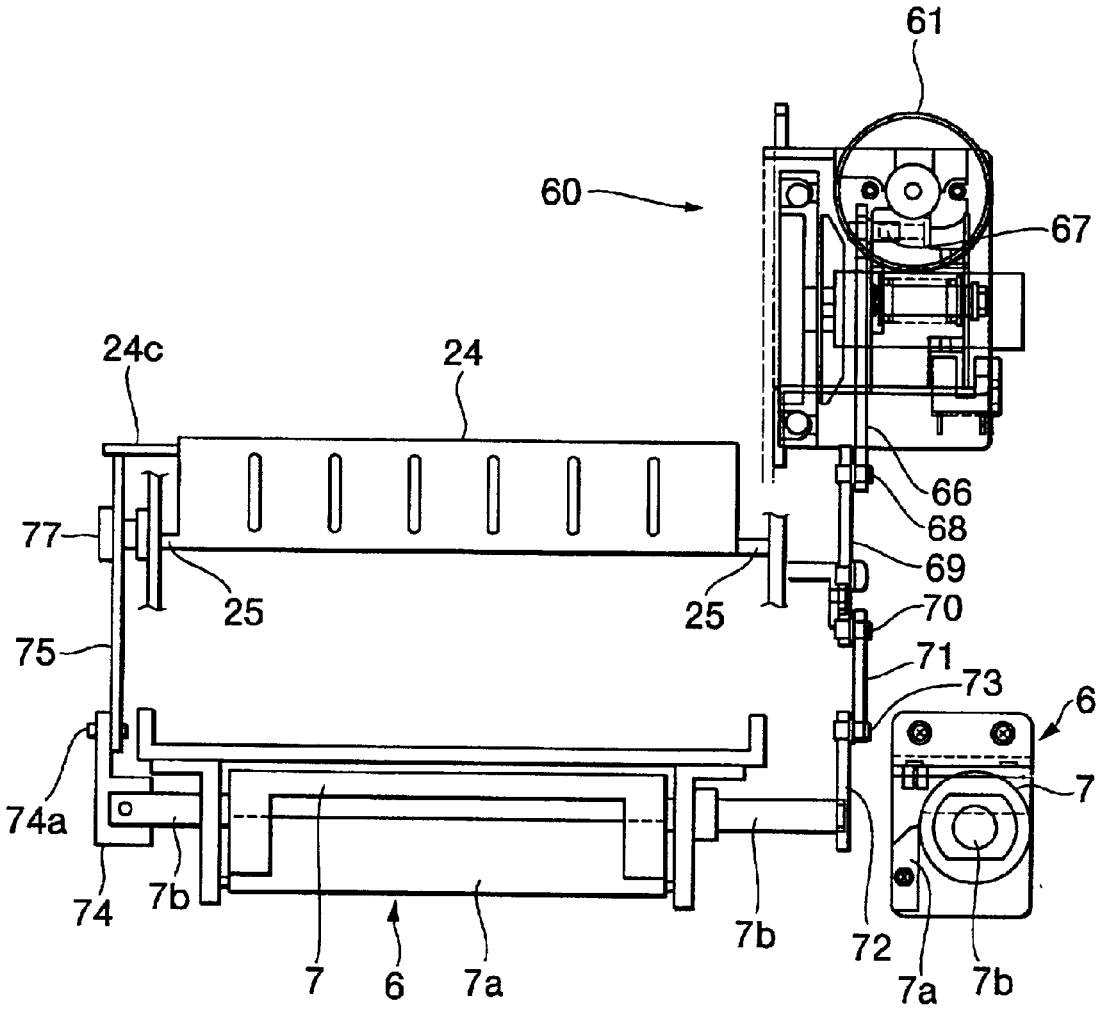
FIG. 3 is an explanatory view showing the image recording apparatus according to a first embodiment of the present invention shown in FIG. 2 and shows a drive motor, a paper feed side cutter and a paper discharge side cutter driven by the motor, and a movable guide arranged outside the platen drum each viewed from the top side.
Figure 4:
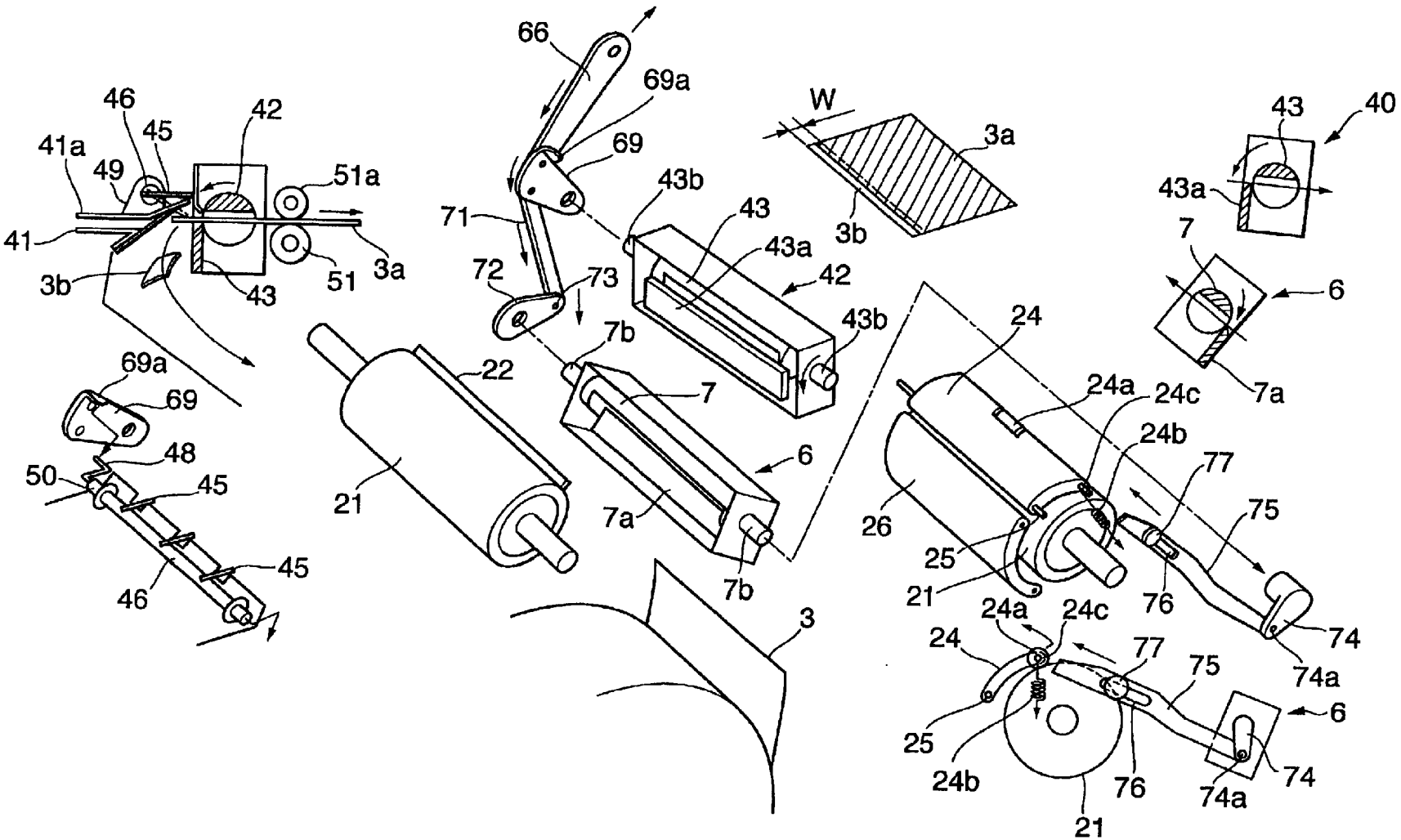
FIG. 4 is an explanatory view showing the first embodiment in which each of the components shown in FIG. 2 is shown in the developed state.

Referring to the drawings in particular, a first embodiment will be described first with reference to FIG. 2 to FIG. 4. FIG. 2 is a side view showing a paper feed means 1, an image recording means 20, a paper discharge means 40, and a drive means 60; FIG. 3 is a flat view showing a cutter in the paper feed side, a movable guide, a drive motor, and a drive system in the paper feed side; and FIG. 4 is a developed perspective view in which the paper feed means 1, image recording means 20, paper discharge means 40, and drive means 60 are shown in the disassembled state respectively.

In each of these figures, the paper feed means 1 comprises a recording medium 3 wound around a feed side core 2, feed-out rollers 4, 4*a* for feeding out the recording medium 3, and a paper feed side cutter 6 comprising a rotary blade 7 and a fixed blade 7*a* and capable of feeding out the recording medium 3 inserted from insert guides 5, 5*a* with paper feed side rollers 8, 8*a* of a paper feed side slide guide 9 at a prespecified rate, stopping a tip of this recording medium 3 at the platen drum, and cutting the recording medium 3.

The image recording means 20 comprises, in addition to a thermal transfer type of ink ribbon and a thermal head not shown in the figure, a platen drum 21, a solenoid-driven damper 22 holding a tip of the recording medium 3*a* therebetween and fixing the tip onto a surface of this platen drum 21, a movable guide 24 with a pinch roller 24*a* provided around the platen drum 21 and constructed so that only the tip of the entrance side is a little raised from a shaft 25 in the rear edge side, and a fixed guide 26 following this movable guide 24, and a rear edge side of the recording medium wound around the platen drum 21 is guided by these guides 24, 26. The reference numeral 24*b* indicates a spring pulling the movable guide 24 to the platen drum 21. The reference numeral 24*c* indicates an arm receiving pin which a tip of a movable guide drive driving arm described hereinafter engages.

The paper discharge means 40 includes a top and bottom paper discharge side slide guides 41, 41*a* for receiving and guiding the recording medium 3*a* with an image already printed thereon released from the platen drum 21 when the platen drum 21 rotates in the reverse direction. A paper discharge side cutter 42 comprises a paper discharge side rotary blade 43 and a fixed blade 43*a* with each attached to a rotary shaft 43*b* and cutting a blank space of the recording medium 3*a* serving as a space for being held by the damper 22. Paper discharge side rollers 44, 44*a* for feed out the recording medium with an image already printed thereon into between the rotary blade 43 and fixed blade 43*a* in the paper discharge side. A patting bar 45 is attached to a rotary shaft 46 for patting off paper waste generated in cutting the recording medium in the front section (entrance side) of the rotary blade 43 and fixed blade 43*a* in the paper discharge side of the paper discharge means 40. A lever 48 is attached to this rotary shaft 46 for rotating the rotary shaft 46 of this patting bar 45 supported by a bearing 49, and this lever 48 contacts an engagement piece 69*a* of a cutter drive lever 69 in the paper discharge side, and when this engagement piece 69*a* rotates, the lever 48, rotary shaft 46, and the patting bar 45 rotates. The reference numeral 50 indicates a return spring for returning the rotary shaft 46 (bar 45) to the original position, while the reference numerals 51, 51 a indicates a paper discharge roller provided in the exit side of the paper discharge side cutter 42, and the recording medium with an image already printed thereon is discharged by this roller from inside of the machine to the outside.

The drive means 60 includes a drive motor 61; a worm 63 attached to a rotary shaft 62 of this drive motor 61; a worm wheel 64 engaging this worm 63 and rotatably attached to a shaft 65; a drive bar 66 with an edge thereof rotatably linked to a radium section of the worm wheel 64 with a shaft 67. A rotary lever 69 of the paper discharge side cutter with a tip of this drive bar 66 is rotatably coupled thereto with a pin 68 and also with the base section thereof fixed to the rotary shaft 43*b* of the rotary blade 43 of the paper discharge side cutter 42. A paper feed side cutter drive lever is 71 rotatably coupled to a far end side of the paper discharge side cutter rotary lever 69 with a pin 70. A paper feed side cutter rotary lever 72 is rotatably coupled to a tip of this paper feed side cutter drive lever 71 with a pin 73 with the base section thereof fixed to the rotary shaft 7*b* of the paper feed side rotary blade 7. An arm drive lever 74 is fixed to the rotary shaft 7*b* of the paper feed side rotary blade 7. A movable guide drive arm 75 is rotatably coupled to this arm drive lever 74 with a pin 74*a* for opening an entrance of the movable guide 24 by raising a receiving pin 24*c* attached to the entrance side of the movable guide 24 at the other end against a force of the spring 24*b*. The reference numeral 76 indicates a slide guide lengthy hole provided in the movable guide drive arm 75, while the reference numeral 77 indicates a slide guide screw positioned in this slide guide lengthy hole 76.

Operations of the image recording apparatus with the configuration described above are described below. The recording medium 3 wound around the feed-out side core 2 is fed out by the feed-out rollers 4, 4*a*, passes through between the paper feed side rotary blade 7 and fixed blade 7*a* and also between the rollers 8, 8*a*, and reaches the platen drum via the paper feed guide 9 with the tip thereof stopped by the damper 22.

When the recording medium is completely clamped, the drive motor 61 rotates, and rotation of this motor 61 makes a worm gear 63 and resultantly a worm wheel 64 by 180 degrees, and rotation of the worm gear 63 and worm wheel 64 by 180 degrees drives the drive bar 66, paper discharge side cutter rotary lever 69, paper feed side cutter drive lever 71, paper feed side cutter rotary lever 72, arm drive lever 74, and movable guide drive arm 75 in this order respectively. As a result, the discharge side rotary blade 43 and paper feed side rotary blade 7 are rotated simultaneously, and in the paper feed side, a rear edge section of one sheet of recording medium 3 is cut off, while a space for being held by the damper is simultaneously cut in the paper discharge side. Further the patting bar 45 rotates for the cut paper waste to be patted off, and at the same time the movable guide arm 75 slides and pushes up the receiving pin 24*c* so that the movable guide 24 opens (at the position indicated by the one-dot and dash line in FIG. 2). When the movable guide 24 is opened, a platen motor (not shown) for driving the platen drum 21 rotates the platen drum 21 counterclockwise in FIG. 2, and then stops once. Then the drive motor 61 drives to rotate the worm wheel 64 further by 180 degrees, when the paper feed side cutter 6, paper discharge side cutter 42, movable guide arm 65, and patting bar 45 return to the original positions (to the position indicated by the solid line in FIG. 2).

The recording process is described below. A thermal transfer type of ink ribbon fed out from a ribbon cassette and a thermal head (not shown) come down to the recording medium 3*a* wound around the platen drum 21 with the thermal transfer type of ink ribbon pressed onto the recording medium 3*a* and the platen motor rotates the platen drum 21. In synchronism to rotation of the platen drum 21, the thermal head is energized according to a given dot for heat emission, and because of the generated heat, coloring materials on the ink ribbon are transferred onto the recording medium 3*a*, thus an image being recorded. After printing with a first color is finished, the thermal head releases the pressure and becomes separated from the platen drum 21 with the ribbon in the ribbon cassette fed out and positioned at its starting position for the next color, and then the platen drum 21 rotates with the recording medium 3*a* positioned at its starting position for printing with the next color. Then the same sequence of operations as that described above is repeated and a color image is recorded on the recording medium 3*a*.

When the platen drum 21 is rotated in the reverse direction, the recording medium 3*a* with an image already recorded thereon is released from the platen drum 21 being guided by the fixed guide 26 and movable guide 24 because a rear edge side of the recording medium 3*a* is free, and the rear edge of the released recording medium 3*a* with an image already recorded thereon enters an entrance of the paper discharge side slide guides 41, 41*a*, and is held and drawn by the rollers 44, 44*a* with the tip thereof removed from the damper 22. Then the recording medium 3*a* passes through between the rotary blade 43 and fixed blade 43*a* both in the paper discharge side, and moves to a prespecified position for cutting being held by the paper discharge rollers 51, 51*a*, when the rotary blade 43 in the paper discharge side described above rotates with the blank space being held by the damper 22 (Refer to FIG. 4) being cut off. The paper waste 3*b* cut off as described above is immediately patted off down by the patting bar 45 and is discharged from inside of the apparatus.

In the present invention, as described above, the paper feed means, recording means, and paper discharge means are arranged so that the recording medium fed out from a roll moves forward from the paper feed means to the recording means and then moves backward from the recording means to the paper discharge means, and because of this configuration, every of the means and drive systems can be incorporated within a small space. Therefore size reduction of an image recording apparatus is possible with the efficient movement of a recording medium, and a time required for recording can substantially be reduced. A time required for recording (finishing) an image on a sheet of recording medium is in a range from 14 seconds to 15 seconds. Further the paper discharge cutter, movable guide, paper discharge cutter, patting bar for patting off paper waste are moved by a single motor in synchronism to one drive system, so that the following effects can be obtained.

1. Any paper waste generated by cutting off blank sections is patted off, so that paper jamming is eliminated.
2. All of the four components are driven by a single motor, which in turn enables size reduction, cost reduction, and power saving of an image recording apparatus.
3. The rotation of a single motor is delivered via a link mechanism for one drive system to all of the four components, so that all of the four components can be operated synchronously and accurately. Therefore, image recording can be performed at a higher speed with synchronism control performed more easily, and also such components can be more simplified.
4. In a guide formed around the platen drum, a pinch roller is attached to the movable guide formed around the platen drum, so that a high quality color image can be obtained without giving any damage to the recording medium.

A second embodiment includes a ribbon tension control as described in detail below with reference to FIG. 5 to FIG. 9. In the image recording apparatus shown in FIG. 5 to FIG. 9, such main components as the platen drum and paper feeder are basically the same as those described in the first embodiment, so that the components are not shown and only the key section is shown.

Figure 5:
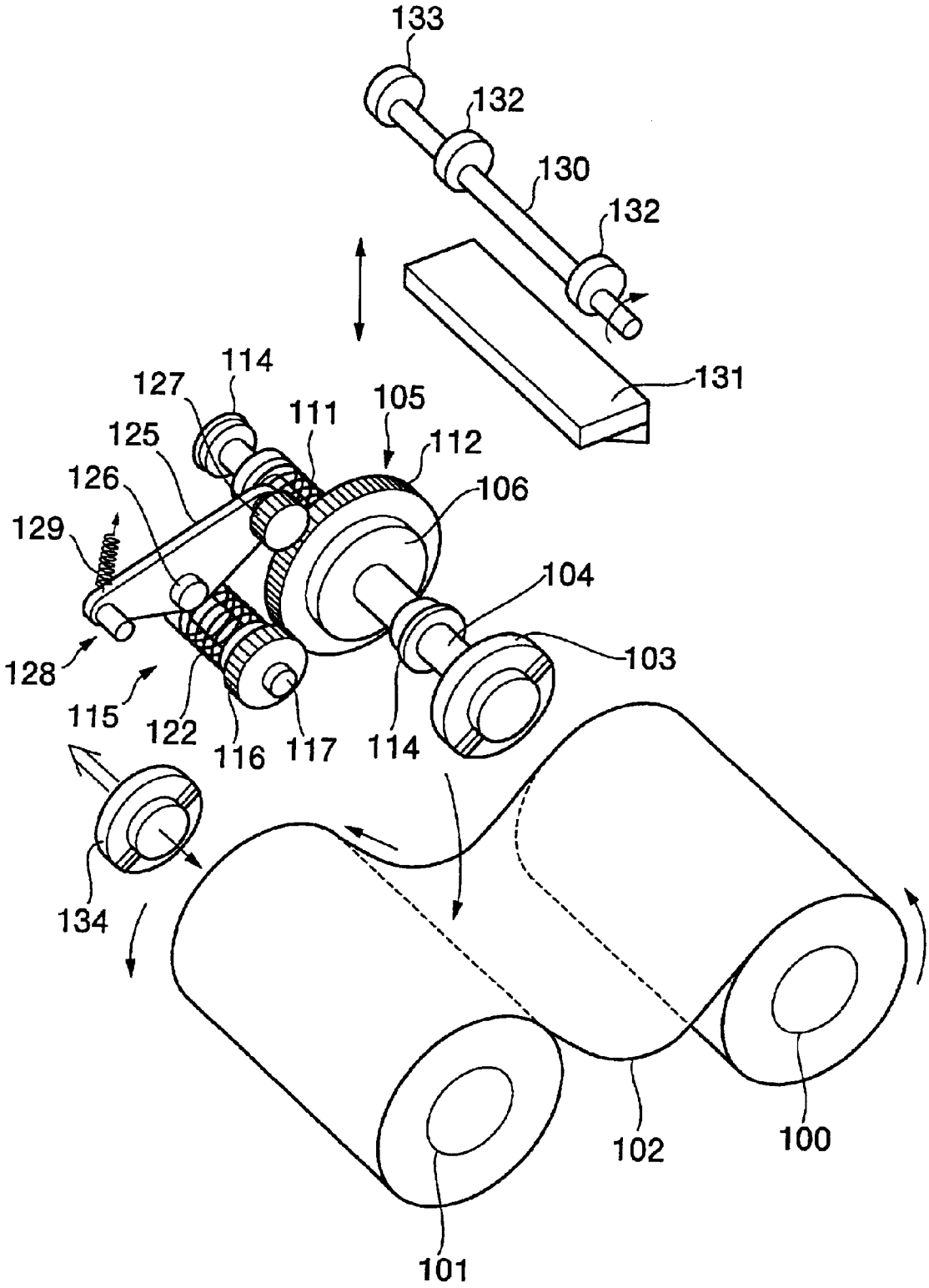
FIG. 5 is an explanatory view showing a key section of a ribbon tension device according to a second embodiment of the present invention.

In FIG. 5 the reference numeral 100 indicates a feed-out core incorporated in a ribbon cassette (not shown), the reference numeral 101 indicates a wind-up core, and the reference numeral 102 indicates a thermal transfer type of ink ribbon known in the technological field. Further the reference numeral 103 indicates a core boss which the core 100 in the feed-out side engages, and this coreboss 103 is coupled via a rotary shaft 104 to a main frictional clutch 105.

Figure 6:
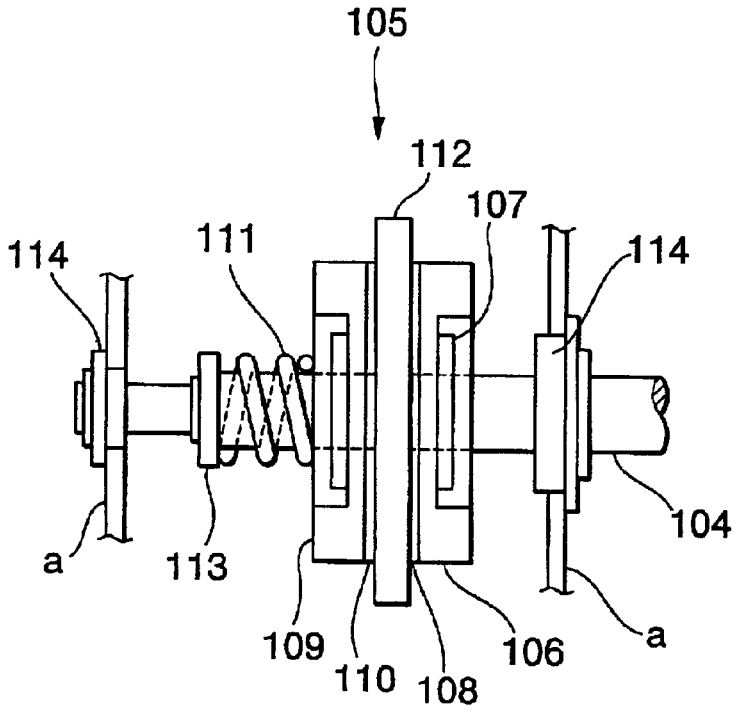
FIG. 6 is an explanatory view showing a main frictional clutch according to the second embodiment of the present invention.

As shown in FIG. 5 and FIG. 6, this main frictional clutch 105 comprises a main frictional disk 106 having a felt 108 fixed with a pin 107 to the rotary shaft 104 in the feed-out side, a slide frictional disk 109 having a felt 110 pushed out by an elasticity-controllable spring 111 to the main frictional disk 106, and a main frictional clutch gear 112 held between the main frictional disk 106 and slide frictional disk 109 via the felts 108 and 110 and also disconnectably attached to the rotary shaft 104 in the feed-out side.

In FIG. 6, the reference numeral 113 is a holder for the spring 111, and elasticity of the spring 111 can be adjusted by sliding this holder 113 with such a tool as a screw on the rotary shaft 104 in the feed-out side. The reference numeral 114 indicates a bearing attached to the frame a.

Figure 7:
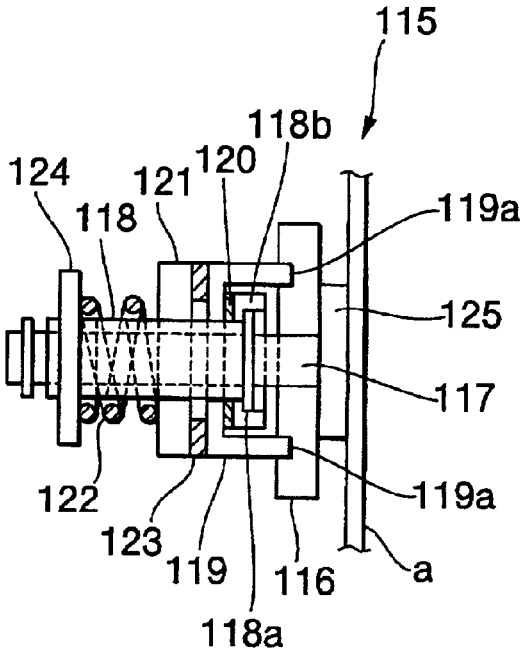
FIG. 7 is an explanatory view showing a sub frictional clutch according to the second embodiment of the present invention.

The reference numeral 115 indicates a sub frictional clutch, and as shown in FIG. 5 and FIG. 7, this sub frictional clutch 115 has a main frictional clutch gear 112 and a sub frictional clutch gear 116 engaging each other, and this sub frictional clutch gear 116 is disengageably connected to the sub clutch shaft 117. The reference numeral 118 indicates a cylindrical shaft 118 attached with a pin 118*a* to the sub clutch shaft 117, and a receiving disk plate 118*b* is formed in the side of the sub frictional clutch gear 116 of this cylindrical shaft 118. The reference numeral 119 indicates a sub frictional clutch disk disengageably attached to the cylindrical shaft 118 with the engagement claw 119*a* engaged in a groove of the sub frictional clutch gear 116, and a felt 120 is provided between this sub frictional clutch disk 119 and the receiving disk plate 118*b*.

The reference numeral 121 indicates a sub frictional disk removably attached to the cylindrical shaft 118, and this sub frictional disk 121 is pushed via the felt 123 by the spring 122 to the sub frictional clutch disk 119. Elasticity of the spring 122 can be adjusted by the spring receiver 124.

Figure 8:
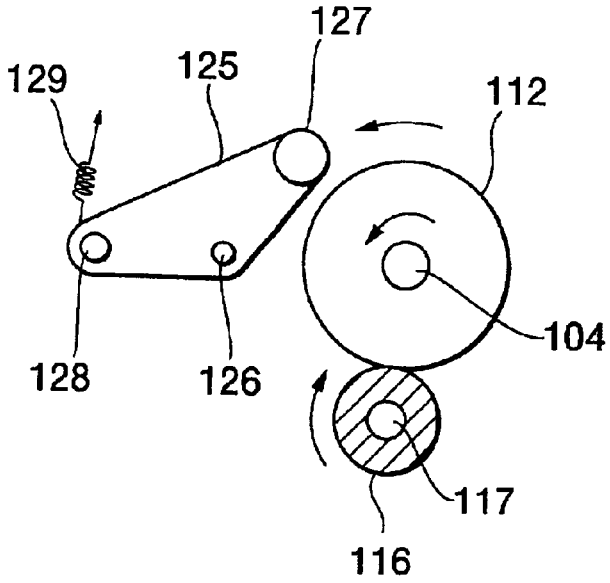
FIG. 8 is an explanatory view showing effects of the sub frictional clutch according to the second embodiment of the present invention in an operation for positioning a recording medium at its starting position.

In FIG. 8, the reference numeral 125 indicates a switch arm rotatably attached by the arm rotary shaft 126 to the frame a, and a stop gear 127 is disengageably attached to the main frictional clutch gear 112 at a tip of this arm 125, while a cam receiving pin 128 is attached to the opposite side. An arm pulling spring 129 is provided on the arm 125 for giving a force to turn the arm 125 clockwise around the arm rotary shaft 126 in FIG. 5 and FIG. 8 and have the stop gear 127 engaged with the main frictional clutch gear 112.

The reference numeral 130 indicates a thermal head up/down cam shaft with a cam 132 for moving up and down the thermal head 131 attached thereto, and when this cam shaft 130 rotates, the thermal head 131 escapes upward for positioning the ribbon at its starting position, and descends and contact the ribbon for heating it when an image is printed thereon.

The reference numeral 133 indicates a clutch switch cam attached to the cam shaft 132, and this cam 133 engages the cam receiving pin 128 of the arm 125, pulls the arm 125 when the thermal head 131 is up and the ribbon is to be positioned at its starting position to lower the cam receiving pin 128 against a power of the spring 129 and rotate the arm 125 counterclockwise about the rotary shaft 126, and separates the stop gear 127 from the main frictional clutch gear 112 to provide controls so that the main clutch gear 112 rotates against a certain degree of frictional resistance by the main frictional disk 106 and slide frictional disk 109. As a result, the main frictional clutch gear 112 rotates the sub frictional clutch gear 116, which in turn rotates the sub frictional clutch disk 19 and the cylindrical shaft 118, and when the sub frictional clutch disk 119 and the cylindrical shaft 118 rotate, a small torque is loaded to the sub frictional clutch disk 119 by the felt 123 in the side of sub frictional disk 121, receiving disk plate 118*b*, and the felt 120 within the sub frictional clutch disk 119, namely the sub frictional clutch disk 119 is weakly braked, and this braking force is delivered from the sub frictional clutch gear 116 to the main frictional clutch gear 112 and main frictional disk 106 to the pin 107, rotary shaft 104, core boss 103 in the feed-out side, core 100 in the feed-out side and to the ribbon 102, and a small tension for positioning the ribbon at its starting position is generated in the ribbon 102 (Refer to FIG. 6 and FIG. 8).

Figure 9:
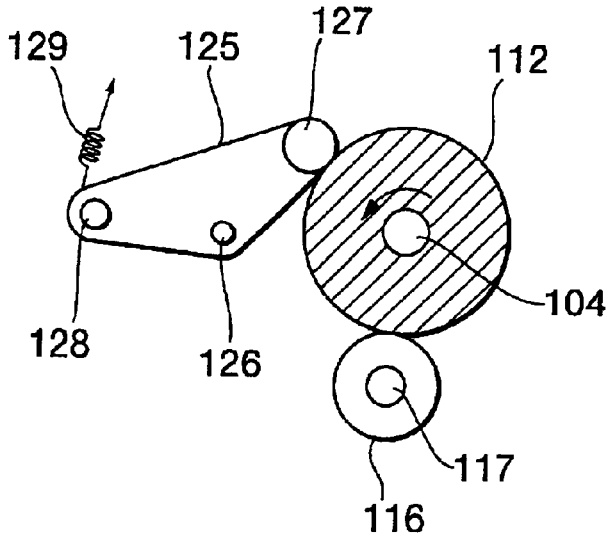
FIG. 9 is an explanatory view showing effects of the main frictional clutch according to the second embodiment of the present invention during a printing operation.

On the contrary, when the cam shaft 130 rotates to make the thermal head 131 descend, as shown in FIG. 5 and FIG. 9, the clutch switch cam 133 escapes from the cam receiving pin 128, and as a result, the arm 125 rotates clockwise because of a force by the spring 129, and the stop gear 127 engages the main frictional clutch gear 112 to fix this main frictional clutch gear 112. As a result, the main frictional disk 106 and slide frictional disk 109 contact and presses the main frictional clutch gear 112 via the felts 108, 110, and this friction generates a large torque to the rotary shaft 104, namely the rotary shaft 104 is strongly braked, and this braking force is delivered from the rotary shaft 104 to the core boss 103 in the feed-out side to the core 100 in the feed-out side, and then to the ribbon 102, thus a large tension being generated in printing an image.

The reference numeral 134 indicates a core boss in the wind-up side rotated by a drive motor (not shown), and this core boss rotates the wind-up side core 101 to wind up the ribbon 102. The tension to the ribbon 102 is decided by this wind-up torque and the braking effect by the main frictional clutch 105 or by the sub frictional clutch 115.

As described above, with the present invention, when a ribbon is to be positioned at its starting position, it is possible to accurately position the ribbon at its starting position by switching from a large load (torque) by the main frictional clutch to a small load (torque) by the sub frictional clutch to reduce the ribbon tension. Further the following effects are provided.

1. A ribbon tension can be set lower when positioning a ribbon at its starting position, so that only a small driving force is required for carrying the ribbon, which enables high speed operations and power saving.
2. A ribbon tension can be set lower when positioning a ribbon at its starting position, so that a ribbon hardly breaks, and also a ribbon which easily breaks can be used.
3. As a sufficiently large tension can be given by the main frictional clutch to a ribbon for printing an image, the capability of transcription is improved, and a high quality color image without any color mismatch can be obtained.

Figure 10:
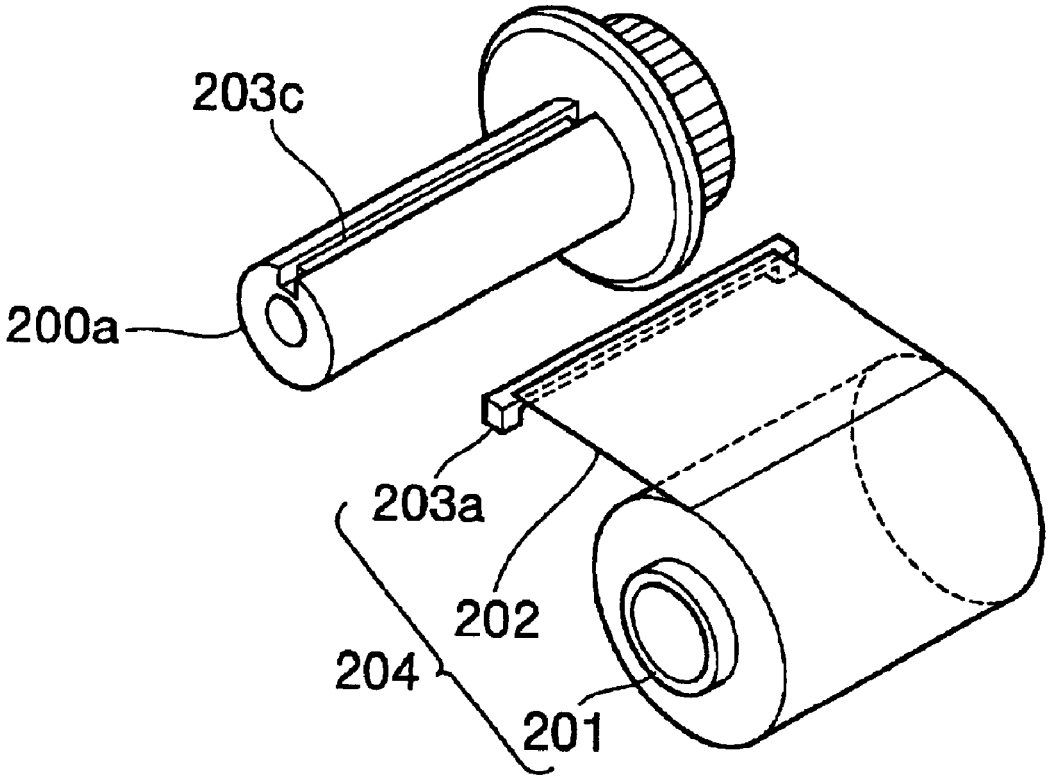
FIG. 10 is an explanatory view showing a ribbon wind-up core and an ink ribbon according to a third embodiment of the present invention.
Figure 11:
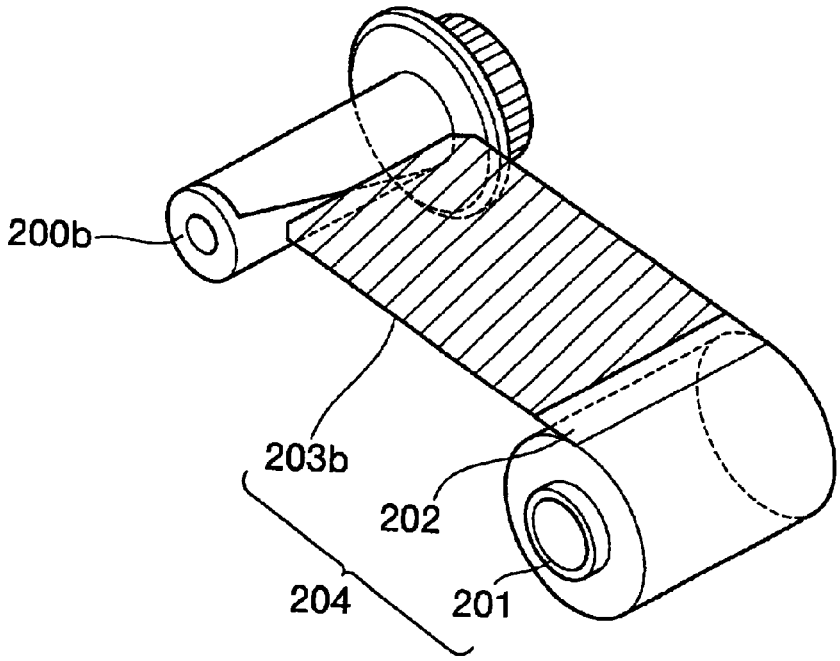
FIG. 11 is an explanatory view showing a ribbon wind-up core and an ink ribbon according to a third embodiment of the present invention.
Figure 12:
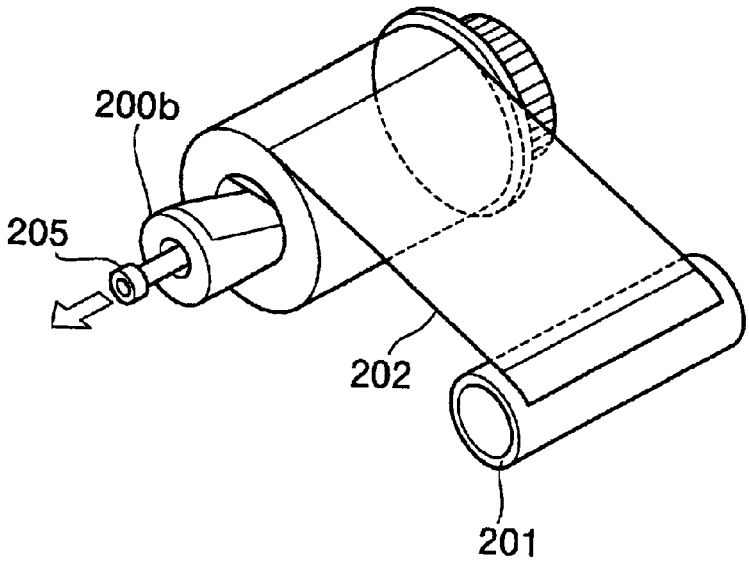
FIG. 12 is an explanatory view showing how to remove a used ribbon from the ribbon wind-up core according to the third embodiment of the present invention.
Figure 13A:
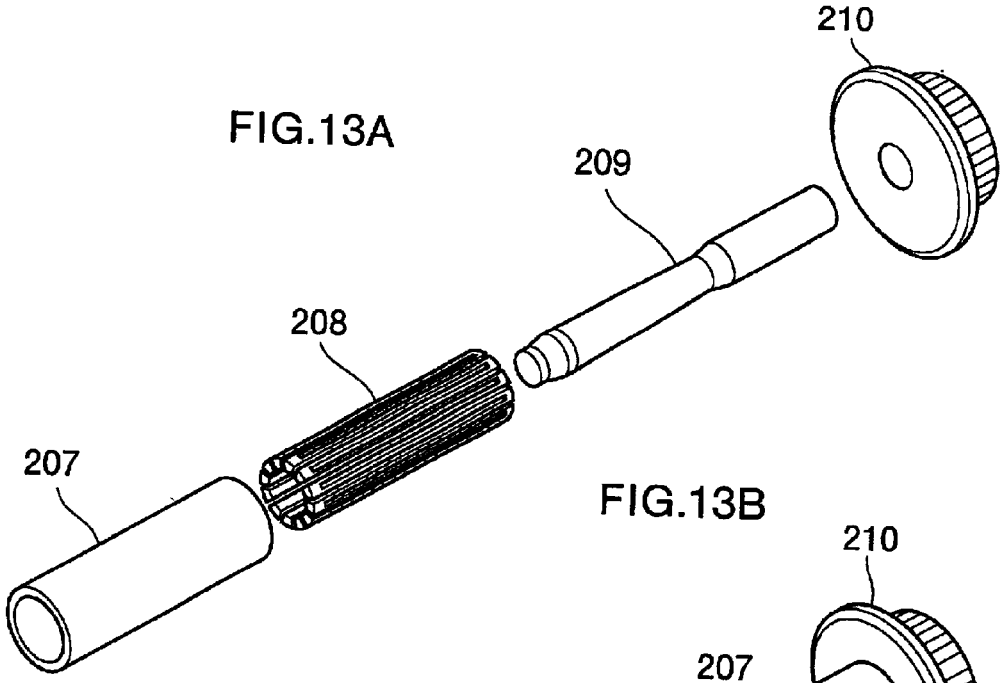
FIG. 13A is an explanatory view showing a disassembled state of an example of a ribbon wind-up core shrinking or extending in the peripheral direction according to the third embodiment of the present invention.
Figure 13B:
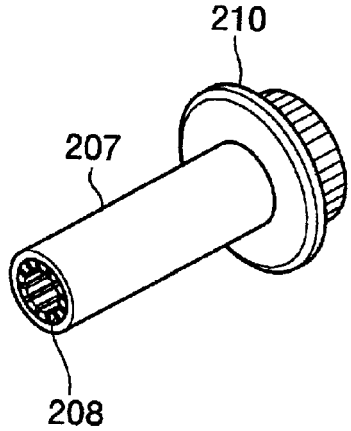
FIG. 13B is an explanatory view showing the same in the assembled state.
Figure 14A:
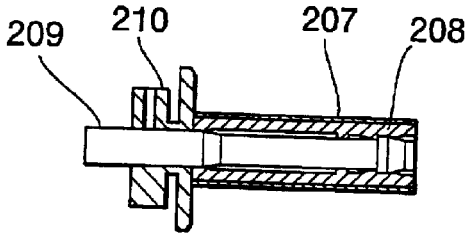
FIG. 14A is an explanatory view showing operations of the ribbon wind-up core shrinking and extending in the peripheral direction according to the third embodiment of the present invention.
Figure 14B:
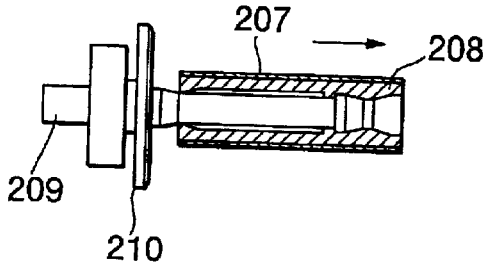
FIG. 14B is an explanatory view showing the state where the core has been drawn out.
Figure 15:
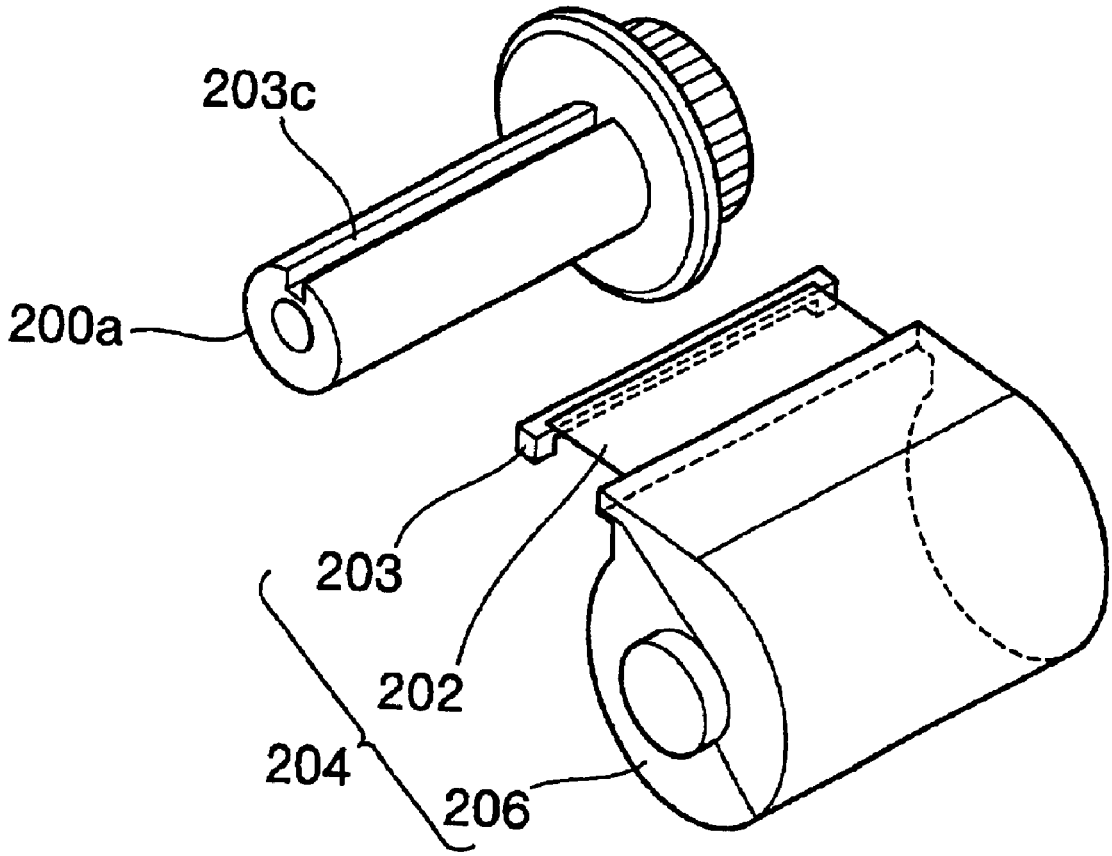
FIG. 15 is an explanatory view showing an example of a ribbon wind-up core as well as of an ink ribbon accommodated in a cassette-like vessel according to the third embodiment of the present invention.

A third embodiment includes an ink ribbon not having a ribbon core in the wind-up side used in the image recording apparatus according to the present invention as described with reference to FIG. 10 to FIG. 17. In FIG. 10 and FIG. 11, the ribbon wind-up cores 200*a*, 200*b* are attached to the image recording apparatus, and are driven by a motor or the like not shown in the figures. The ink ribbon 204 comprises a ribbon core 201 in the feed-out side, an ink ribbon film 202, a ribbon leader clip 203*a*, or a ribbon leader tape 203*b*. In the ribbon wind-up core 200*a*, a ribbon leader clip 203*a* is inserted into a groove 203*c* provided in the ribbon wind-up core 200*a* to fix a tip of the ink ribbon film 202. When the ink ribbon film 202 is completely used to its end, the ribbon film 202 is wound back to the ribbon core 201 and is removed together with the used ink ribbon. The ribbon wind-up core 200*b* shown in FIG. 11 is a ribbon wind-up core based on the divided system, and after the ink ribbon film 202 is completely used to its end, a clamp screw 205 is removed as shown in FIG. 12, the core is divided, and the used ink ribbon film 202 is removed. An example of a ribbon wind-up core which can extend and shrink in the peripheral direction is shown in FIGS. 13A, 13B and FIGS. 14A, 14B. The ribbon wind-up core comprises a surface coating 207 such as rubber, a comb-shaped cylinder 208 which can extend and shrink in the peripheral direction, a shaft 209, a flange, and a pulley 210. After the ink ribbon film 202 is completely used to its end, when the comb-shaped cylinder 208 is drawn out in the axial direction as shown in FIG. 14B, the ink ribbon film 202 shrinks in the peripheral direction due to a shrinking force of the coating 207 such as rubber, and it becomes possible to easily pull out the wound-up ink ribbon film 202. An example of the ink ribbon film 202 accommodated in a cassette-shaped vessel is shown in FIG. 15. Shown in this figure is the ink ribbon 204 shown in FIG. 10 accommodated in the cassette-shaped vessel 206.

Figure 16:
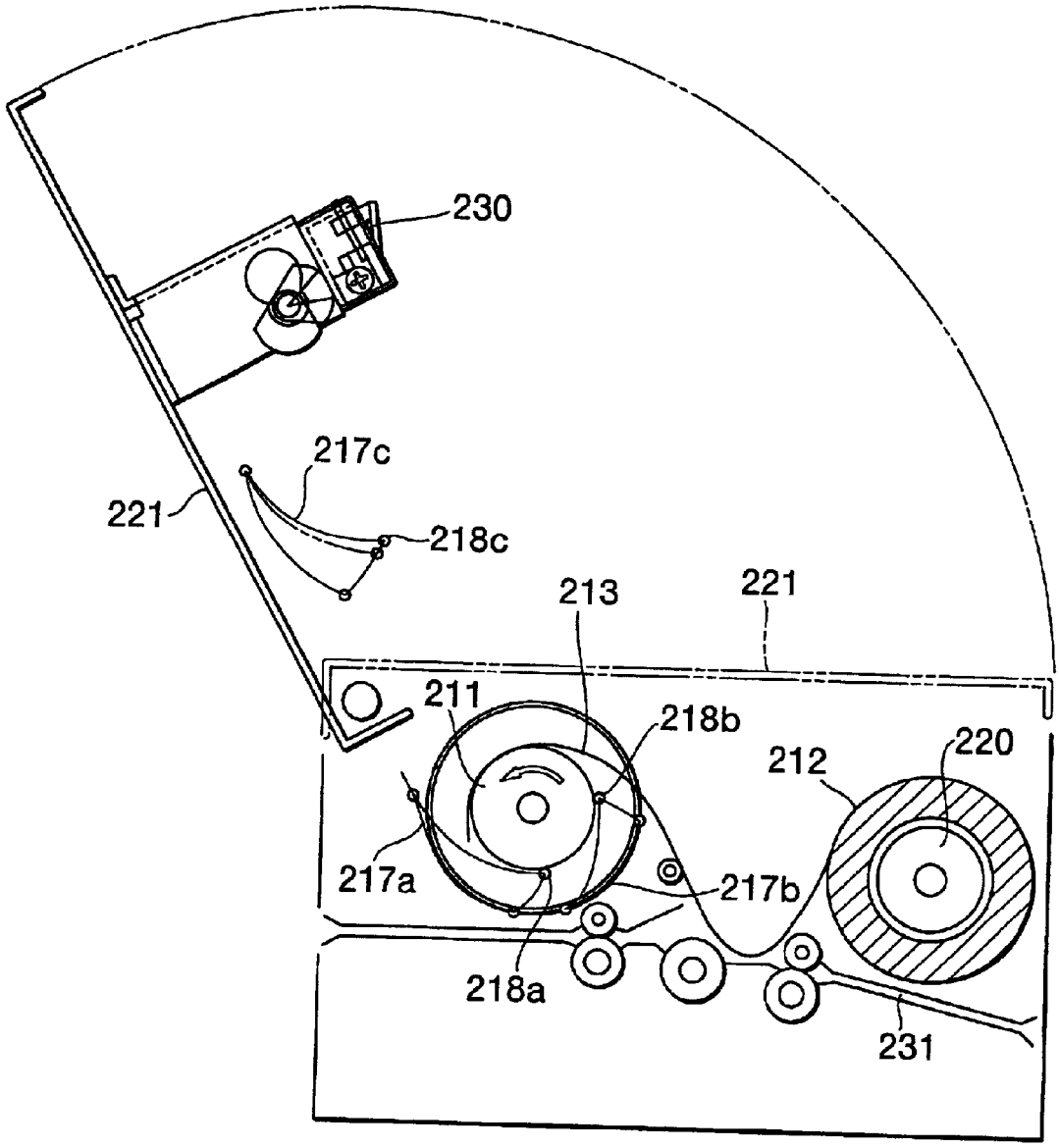
FIG. 16 is an explanatory view showing the inside of a main portion of an example of the image recording apparatus according to the third embodiment of the present invention.
Figure 17:
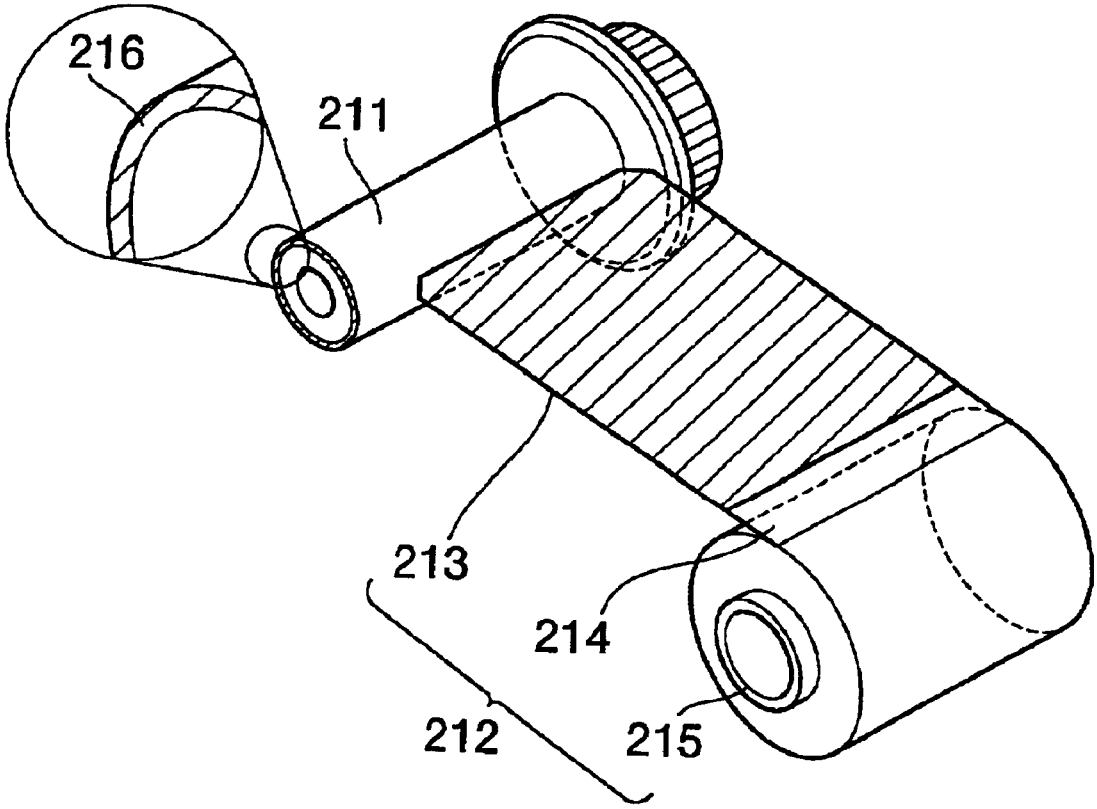
FIG. 17 is an explanatory view showing an example of a ribbon wind-up core for automatic loading as well as of an ink ribbon according to the third embodiment of the present invention.

Further, an example of an image recording apparatus having an automatic loading mechanism and an example of an ink ribbon each according to the present invention are shown in FIG. 16 and in FIG. 17 respectively. Herein an ink ribbon 212 having a ribbon leader tape 213 is used, and the image recording apparatus has a ribbon wind-up core 211 which can extend or shrink in the peripheral direction or which can be divided. The coating 207 such as rubber for making higher a friction coefficient with the ribbon leader tape 213 is provided on a surface of the ribbon wind-up core 211. Further rotatable ribbon guides 217*a*, 217*b*, 217*c* having rollers 218*a*, 218*b*, 218*c* respectively are provided at a tip of a basic body of the image reporting apparatus, and the ribbon leader tape 213 or the ink ribbon film 214 is pressed to the ribbon wind-up core 211 by a spring or the like now shown in the figures and is used as a guide for setting a ribbon because of the form.

An example of an operation for automatic loading in the present invention is described below. At first, a cover 221 is opened as shown in FIG. 16, and the ink ribbon 212 shown in FIG. 17 is set therein by inserting the feed-out side ribbon core 215 into the ribbon attachment boss 220 supported in the cantilevered form. Then the ribbon leader tape 213 is hung over the ribbon wind-up core 211 in the slacked state as shown in FIG. 16. The cover 221 is shut in this state, when a roller 218*c* at a tip of the ribbon guide 217*c* presses the ribbon leader tape 213 to the ribbon wind-up core 211. When the ribbon wind-up core 210 is driven in this state in the winding-up direction, the ribbon leader tape 213 is wound around the ribbon wind-up core 211 and passes under the ribbon guides 217*a* and 217*b* sequentially. When the ribbon leader tape is wound up more, the ribbon leader tape 213 suppresses itself, and is wound around the ribbon wind-up core 211 without slacking because of the difference between friction coefficients of the ribbon leader tapes 213 and a coating 216 such as rubber on a surface of the ribbon wind-up core. Then the ink ribbon is wound up by a required quantity and positioned at its starting position, thus automatic loading of the ink ribbon 212 being finished. In FIG. 16, designated at the reference numeral 230 is a thermal head, at 231 a recording medium guide.

It should be noted that the present invention is not limited to the embodiments described above, and the image recording apparatus according to the present invention can be changed according to a size and a form of the product and characteristics of components such as an ink ribbon.

Figure 18:
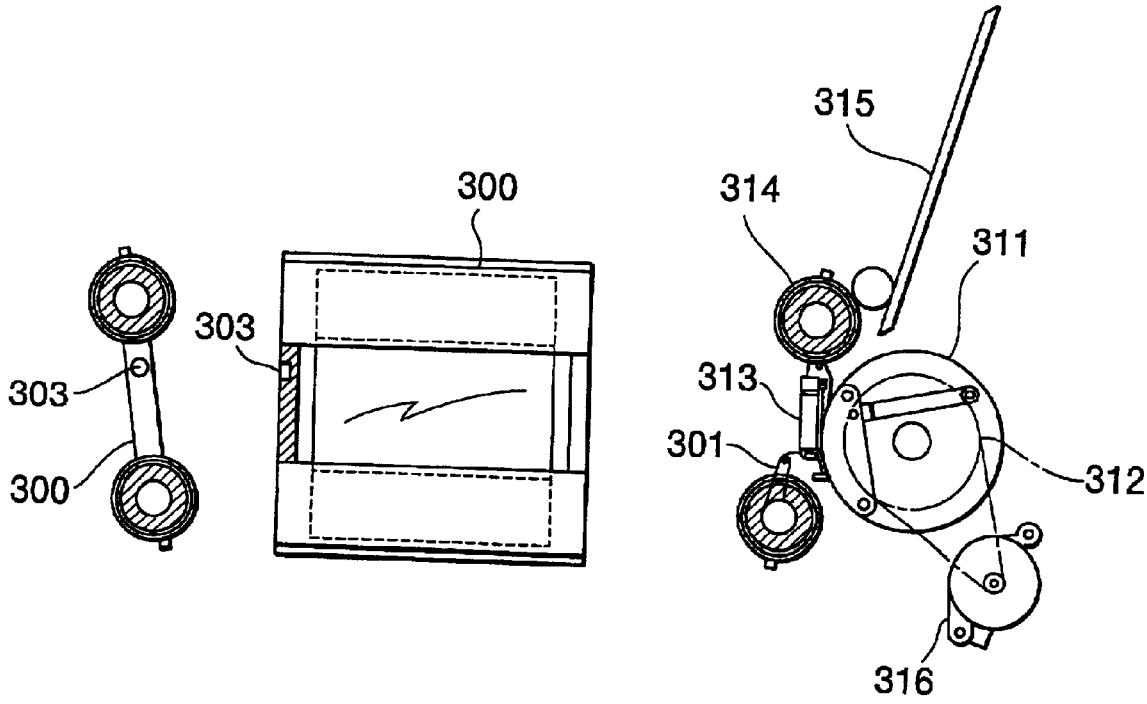
FIG. 18 is an explanatory view showing an example of the image recording apparatus using an example of the ribbon cassette according to a fourth embodiment of the present invention.
Figure 19:
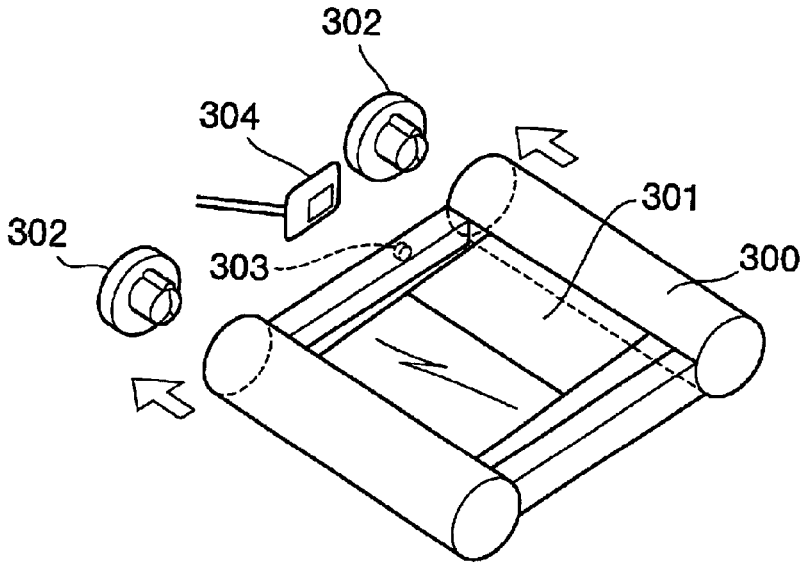
FIG. 19 is an explanatory view showing an example of the ribbon cassette according to the fourth embodiment of the present invention.
Figure 20:
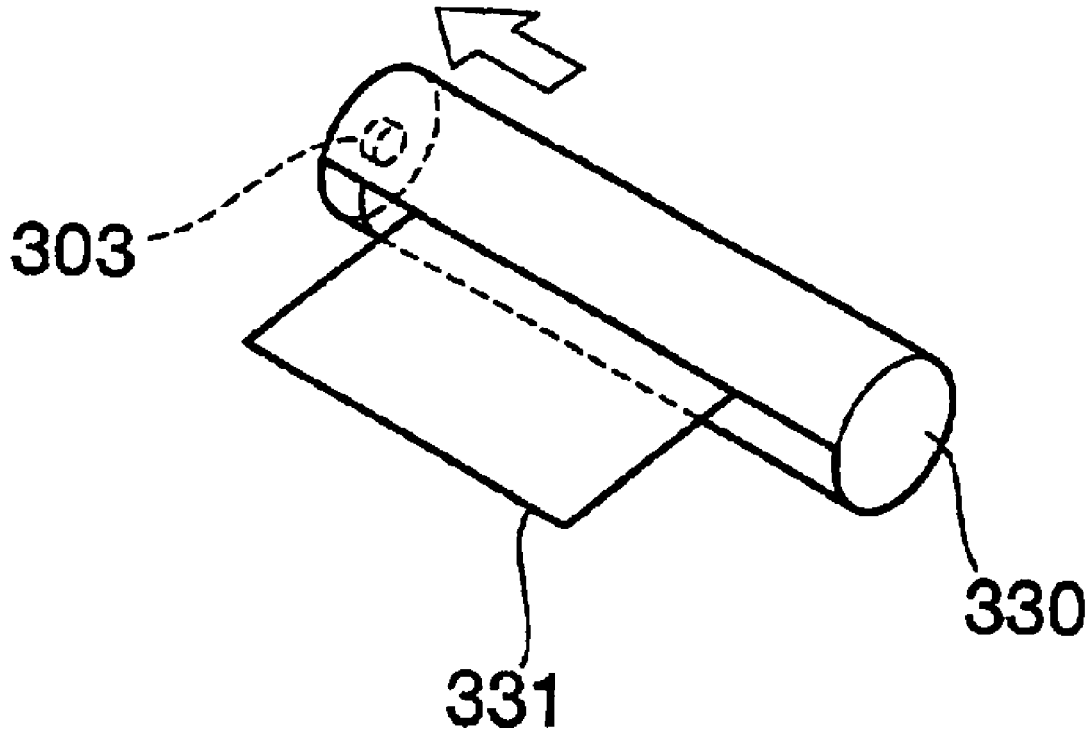
FIG. 20 is a general concept view showing a ribbon cassette according to another embodiment of the present invention.

A fourth embodiment includes a ribbon cassette as described below with reference to FIG. 18 to FIG. 20. FIG. 18 is a view showing one embodiment of the present invention. FIG. 19 is a simplified view showing one embodiment of a ribbon cassette 300 according to the present invention.

This ribbon cassette comprises, as shown in FIG. 18 a thermal transfer type of ink ribbon 301, a recording medium 311, a platen drum 312, a thermal head 313, a ribbon cassette 300, and a non-contact IC chip 303 each as a main component.

Shown in FIG. 19 are a ribbon cassette 300, a thermal transfer type of ink ribbon 301, a ribbon wind-up mechanism 302, a non-contact IC chip 303 attached to the ribbon cassette 300, a power supply/data collection antenna and a circuit section 304. The thermal transfer type of ink ribbon 301 are colored with different colors cyclically, and for instance, three colors of yellow, magenta, and cyan form one group. In some cases, other colors including black may be used, or a surface of the ink ribbon 301 may be coated with a transparent coating material. At first, a section with a desired color of the thermal transfer type of ink ribbon 301 is positioned at its starting position. Then a recording medium 311 from a recording medium hopper 315 is wound around a platen drum 312 and is carried up to a thermal head 313. Then the recording medium 311 and the thermal transfer type of ink ribbon 301 transferred thereto are held between the platen drum 312 and thermal head 313 with a pressure loaded thereto by the thermal head 313. A platen drum drive motor 316 rotates the platen drum 312, and the thermal head 313 is energized and emits heat in synchronism to rotation of the platen drum 312 according to a given dot so that heated coloring materials are transferred from the thermal transfer type of ink ribbon 300 closely contacted to the recording medium 311 to the recording medium 311, thus an image being formed on the recording medium 311. As shown in FIG. 18 and FIG. 19, the ribbon cassette 300 with the thermal transfer type of ink ribbon 301 set therein has an IC chip in which such data as those concerning characteristics of the ribbon and a residual quantity of the ribbon are recorded, namely a chip 303 in which a coil and a semiconductor circuit are integrated with each other incorporated therein. In the image recording apparatus, the data recorded in this IC chip 303 is read with the circuit section 304 to obtain data on printing conditions or a residual quantity of ribbon so that optimal image quality or operations can be obtained. In addition, data on such factors as a residual quantity of ribbon changing from time to time is written in the IC chip 303 for recording.

The ribbon cassette according to the present invention is not limited to the looking glass type ribbon cassette as shown in FIG. 19. In another embodiment of the present invention the IC chip 303 is incorporated in the ribbon insertion side of the reader tape type of single ribbon cassette 330 shown in FIG. 20.

When the ribbon cassette 330 incorporating the IC chip 303 as described above is mounted in an image recording apparatus, the apparatus supplies a power with, for instance, an electromagnetic wave in a non-contact form to the IC chip 303 within the ribbon cassette 330, and data can be obtained in a non-contact form with the circuit section 304 (Refer to FIG. 19) from the IC chip 303 within the ribbon cassette 330, and further data can be written in the IC chip 303 within the ribbon cassette 330 similarly in a non-contact form.

Figure 21:
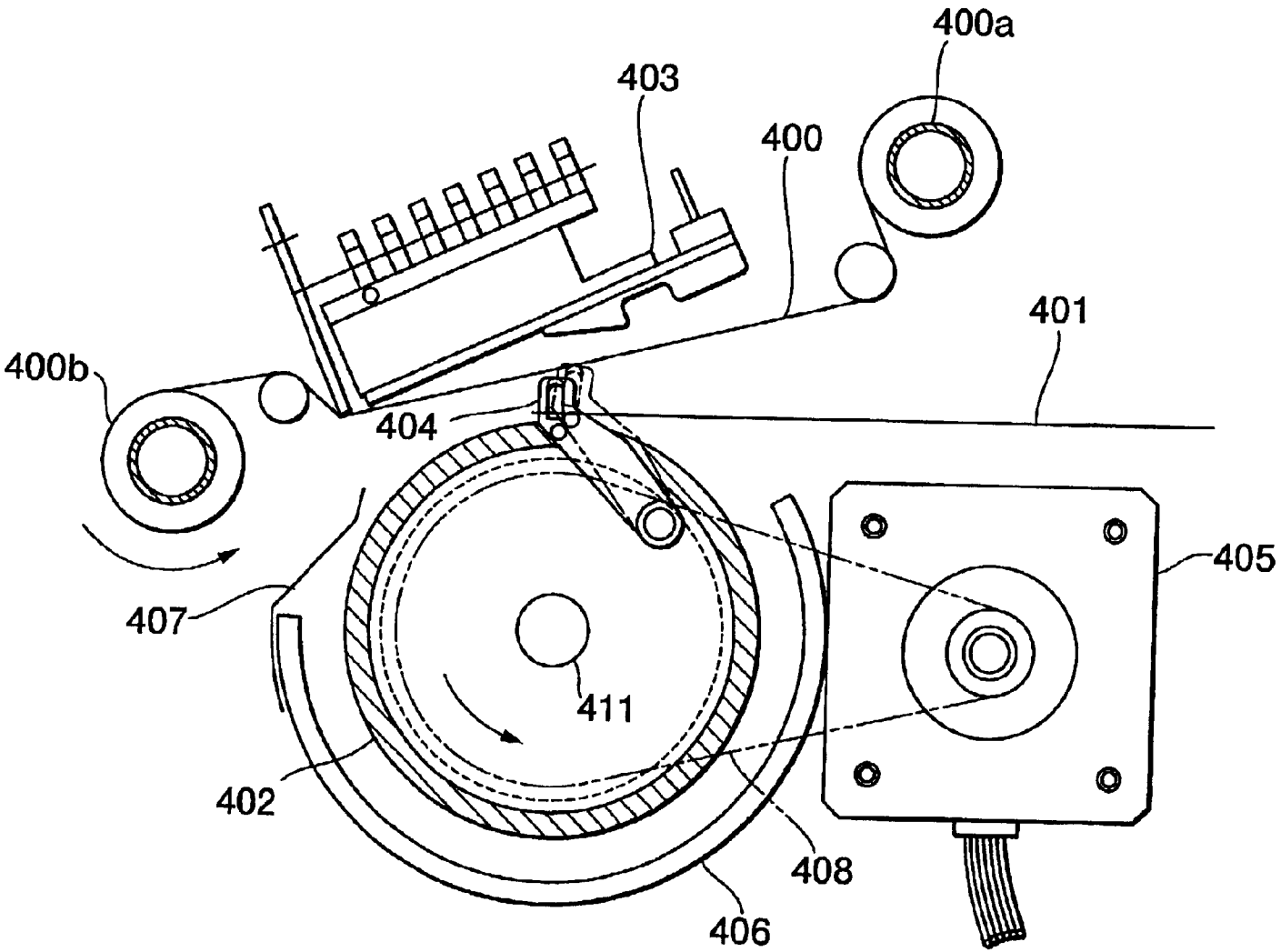
FIG. 21 is an explanatory view showing a state where paper is being fed in a fifth embodiment of the present invention.
Figure 22:
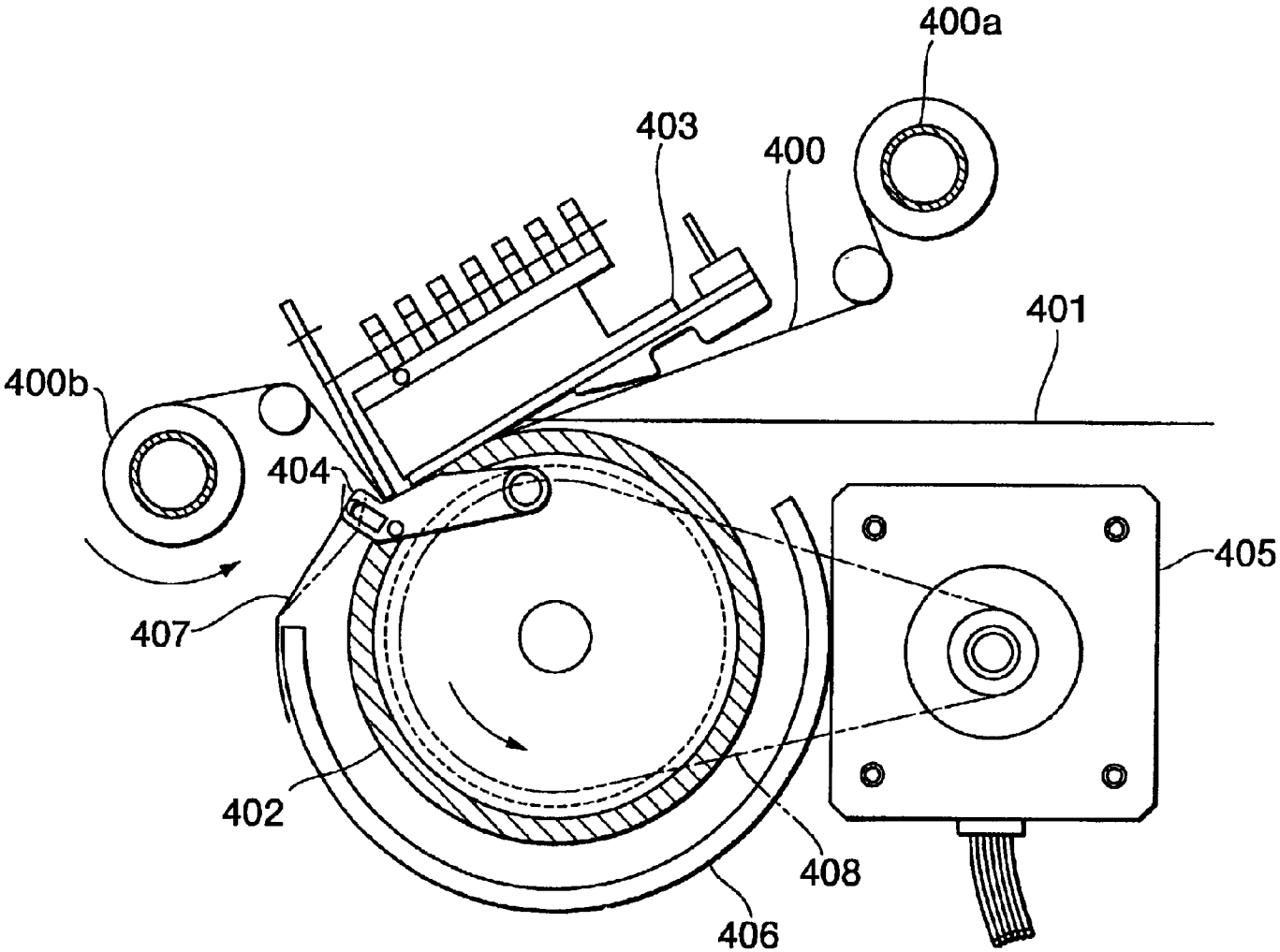
FIG. 22 is an explanatory view showing a state where an image is just to be printed in the fifth embodiment of the present invention.
Figure 23:
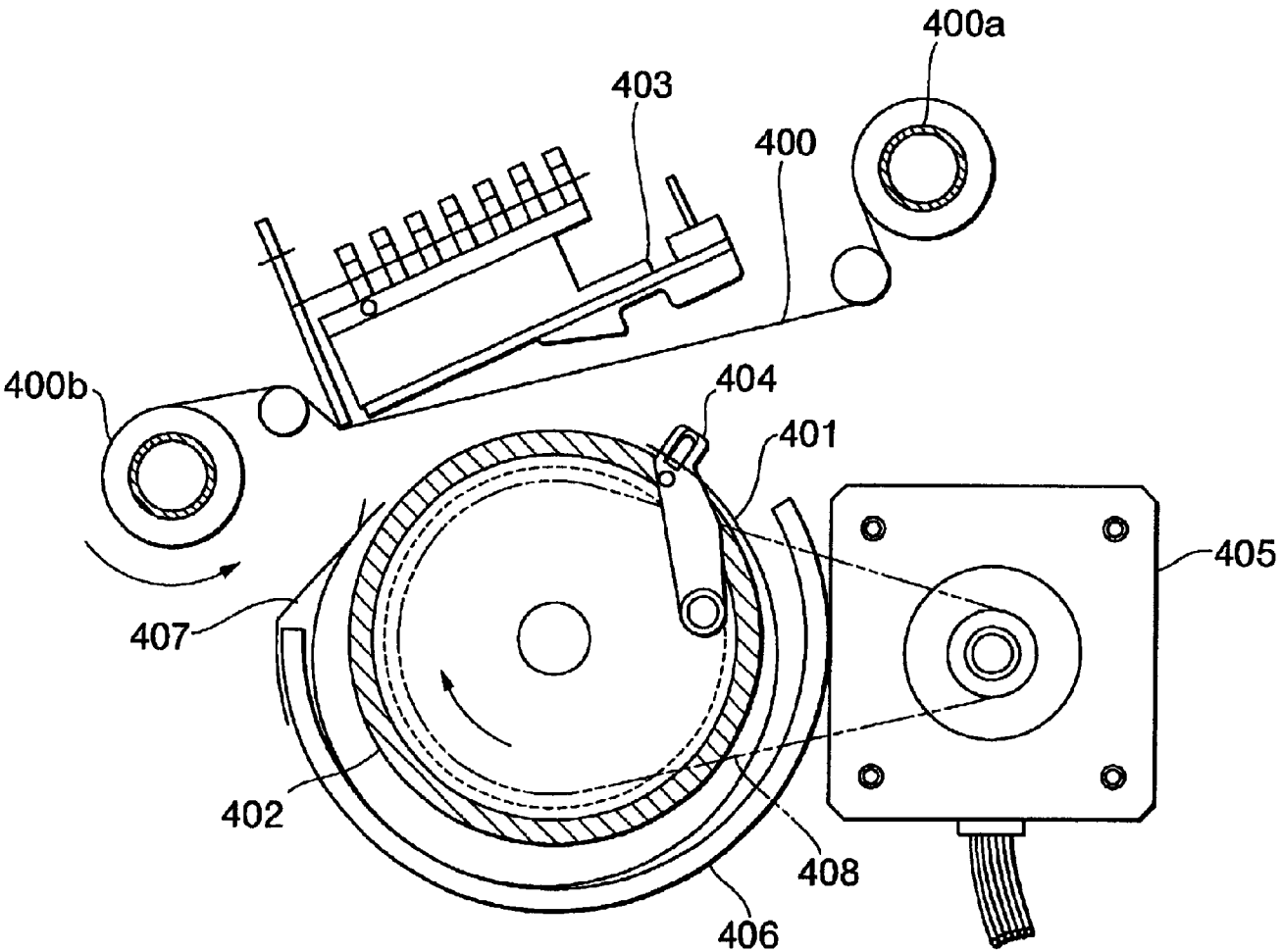
FIG. 23 is an explanatory view showing a state where paper is reversed and discharged in the fifth embodiment of the present invention.
Figure 24A:
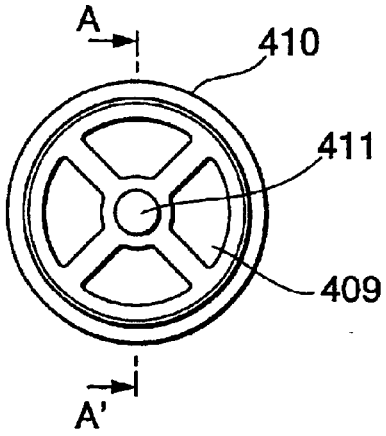
FIG. 24A is a side view showing configuration of the platen drum according to the fifth embodiment of the present invention.
Figure 24B:
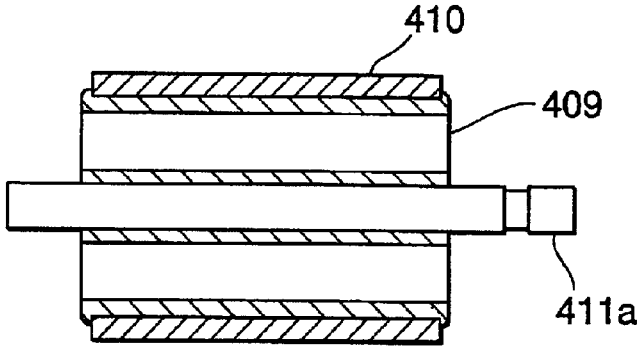
FIG. 24B is a cross-sectional view showing the platen drum according to the fifth embodiment of the present invention taken along the line A–A' in FIG. 24A.
Figure 25A:
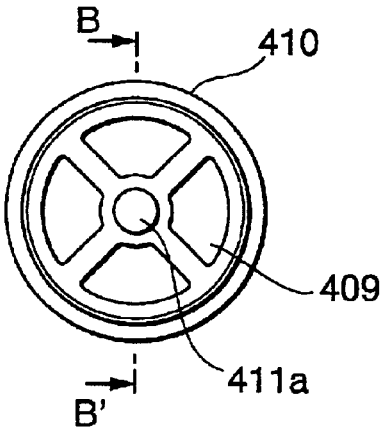
FIG. 25A is an explanatory view showing another configuration of the platen drum according to the fifth embodiment of the present invention.
Figure 25B:
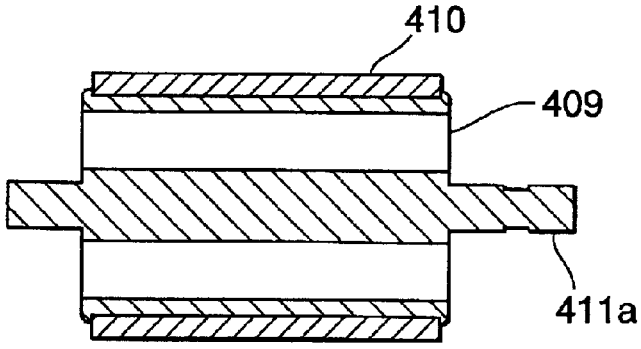
FIG. 25B is a cross-sectional view showing the platen drum according to the fifth embodiment of the present invention taken along the line B–B' in FIG. 25A.

A fifth embodiment of the invention includes a guide for a recording medium formed on the periphery of the platen drum in the image recording apparatus as described with reference to FIG. 21 to FIG. 24. FIG. 21, FIG. 22, and FIG. 23 are general views showing the state where paper is being fed, the state where printing is just started, and the state where the printed paper is just discharged respectively. In FIG. 21, this image recording apparatus comprises a thermal transfer type of ink ribbon 400, a recording medium 401, a platen drum 402, a thermal head 403, a damper 404, a platen drum drive motor 405, a form guide 406 arranged so that it surrounds the platen drum 402 by about 220 degrees, a form guide 407 with a spring provided at an entrance of the form guide 406, and a platen drive belt 408 each as a main component. In FIG. 21, the thermal head 403, thermal transfer type of ink ribbon 400, recording medium 401, and platen drum 402 are provided in this sequence. The platen drum 402 comprises a drum 409 made from resins, a rubber-made molded item 410, and a metallic shaft 411 as shown in FIG. 24A and FIG. 24B, or comprises a plastic drum 409 integrated with the shaft 411 a and a rubber-made molded item 410 as shown in FIG. 25A and FIG. 25B.

The thermal transfer type of ink ribbon 400 is the same as that based on the conventional technology which is fed out from the feed-out side core 400*a* and wound around the wind-up side core 400*b*. Namely the ink ribbon may be monochrome (for instance, black) one, or maybe colored with different colors cyclically (for instance, yellow, magenta, and cyan in this order). In some cases, a black ribbon or that coated with an overcoating material for protecting the surface thereof may be used. The following is a description of a case where a three-color ribbon is used.

At first, when a image printing operation is started, the thermal head 403 and damper 404 are off from the platen drum 402, so that the recording medium 401 can be carried. The recording medium 401 is carried in this state, namely paper feeding is performed with a tip thereof fixed onto the platen drum 402 with the damper 404, and the printing operation is started. FIG. 22 shows the state. The thermal head 403 and damper 404 may be operated and the recording medium 401 may be carried either manually or automatically.

After the printing operation is started, at first the thermal transfer type of ink ribbon 400 is positioned at its starting position for a desired color. Then positioning of the platen drum 402, namely positioning of a form at its starting position is performed by the platen drum drive motor 405 so that the recording medium 401 is positioned at the starting position for printing.

The damper 404 passes over the form guide 407 having the springing capability before a heater line of the thermal head 403 enters the printing range, so that no bad effect is given to the image quality even if the thermal head 403 goes over the form guide 407 with the springing capability. After the form is positioned at its starting position, to achieve close contact between the thermal transfer type of ink ribbon 400 and the recording medium 401, the thermal head 403 is moved toward the platen drum 402 to load an appropriate pressure. FIG. 22 shows this state. Then the platen drum 402 is driven by the drive motor 405. The thermal head 403 is energized according to a given dot in synchronism to rotation of the motor 405 for heat emission. The coloring materials are transferred from the thermal transfer type of ink ribbon 400 onto the recording medium 401 because of this heat and a pressure between the thermal head 403 and the platen drum 402. An image is formed. After printing with a first color is finished, the thermal head 403 is separated from the platen drum 402, the thermal transfer type of ink ribbon 400 is fed out for positioning it at its starting position for the next color. At the same time the platen drum 402 is rotated, and then the form is positioned again at its starting position. In this step, the form enters between the platen drum 402 and the form guide 406, and is restricted at the minimum required without any damage given to a surface of the form. Further the same operation sequence as that described above is repeated to form an image with the next color. This operation sequence is repeated the required times to form a color image. Although it is possible to rotate the platen drum 402 in the reverse direction for discharging the form in the paper discharge step after formation of the color image, as the form guide 407 has the springing capability in this configuration, the form can smoothly be discharged without a rear edge of the form contacting the thermal head 403. This state is shown in FIG. 23. It should be noted that the paper discharging step is not limited to that described above.

As described above, in the image recording apparatus according to the present invention, a pinch roller for pressing a form to the platen drum 402 is not provided. The form guide 406 is employed, so that it becomes possible to retain a form without having any bad effect over the image quality. Also, the number of components is reduced, thus image printing is performed under stable conditions. Further as the movable guide 407 having the springing capability is used in a portion of the form guide 406, it is possible to get the form guide 407 close to a surface of the platen drum 402 without affecting the image quality, so that the excellent performance applicable to practical use can be realized with a small number of components.

By changing a method of producing the platen drum 402, it is possible to mold a core of the platen drum 402 and a rubber-made surface portion thereof separately, so that the manufacture is very easy with the weight reduced. Especially, when produced in mass, mass production can be performed by producing both the resin-made drum and rubber-made surface portion with different dies respectively. This enables improvement in production yield and simplification of inspection process.

With the combinations described above, improvement of image quality can be achieved together with reduction of a number of components in the image recording apparatus according to the present invention. Further a production process adapted to mass production can be employed, so that, in addition to improvement of production yield and simplification of inspection step, also cost reduction can be achieved. Because of the features described above, it is expected that the present invention will make a large contribution to the popularization of this type of image recording apparatus applicable to use as an image recording apparatus available in laboratories and capable of giving an excellent quality product, better than that of a silver chloride picture.

Although the form guide 407 having the springing capability is used to evade the damper 404 in this embodiment, the movable guide 24 is used in the first embodiment.

While specific embodiments of the invention have been shown and described in detail to illustrate the application of the principles of the invention, it will be understood that the invention may be embodied otherwise without departing from such principles.

What is claimed is:

1. An image recording apparatus for recording an image by heating a thermal transfer type of ink ribbon with a thermal head and transferring the heated coloring material on a sheet-formed recording medium wound around a platen drum, said image recording apparatus comprising:

a tension switch means for switching tension of the ink ribbon to a larger value or a smaller value provided in the ribbon feed-out side, wherein said tension switch means is switched to a larger value when an image is to be recorded, and to a smaller value when the ribbon is to be positioned at its starting position;

a tension switch cam on a thermal head up/down cam shaft for diving the thermal head, wherein said tension switch means can be switched in synchronism to upward or downward movement of the thermal head.

2. The image recording apparatus of claim 1, wherein said tension switch means comprises a main frictional clutch for controlling the tension to the larger value in synchronism to up/down movement of the thermal head and a sub frictional clutch for controlling the tension to the smaller value side.

3. An image recording apparatus for recording an image by heating a thermal transfer type of ink ribbon with a thermal head and transferring the heated coloring material on a sheet-formed recording medium wound around a platen drum, said image recording apparatus comprising:

a tension switch means for switching tension of the ink ribbon to a larger value or a smaller value provided in the ribbon feed-out side, wherein said tension switch means is switched to a larger value when an image is to be recorded, and to a smaller value when the ribbon is to be positioned at its starting position, wherein said tension switch means comprises a main frictional clutch for controlling the tension to the larger value in synchronism to up/down movement of the thermal head and a sub frictional clutch for controlling the tension to the smaller value side.

4. An image recording apparatus using a sheet-formed recording medium, the apparatus comprising:

a platen drum for receiving the sheet-formed recording medium being wound around said platen drum;

a thermal transfer type of ink ribbon;

a thermal head heating said thermal transfer type of ink ribbon and transferring heated coloring material onto the sheet-formed recording medium around said platen drum;

a tension switch means for switching tension of said ink ribbon to a larger value or a smaller value provided in a ribbon feed-out side, wherein said tension switch means is switched to a larger value when an image is to be recorded, and to a smaller value when the ribbon is to be positioned at a starting position.

* * * * *